US009645527B2

(12) United States Patent
Saito et al.

(10) Patent No.: US 9,645,527 B2
(45) Date of Patent: May 9, 2017

(54) IMAGE FORMING APPARATUS HAVING TONER CONTENT SENSOR

(71) Applicant: CANON KABUSHIKI KAISHA, Tokyo (JP)

(72) Inventors: Fumiyoshi Saito, Toride (JP); Noriyuki Okada, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/964,841

(22) Filed: Dec. 10, 2015

(65) Prior Publication Data

US 2016/0170353 A1 Jun. 16, 2016

(30) Foreign Application Priority Data

Dec. 12, 2014 (JP) ..... 2014-252135

(51) Int. Cl.
*G03G 15/08* (2006.01)
*G03G 15/00* (2006.01)

(52) U.S. Cl.
CPC ..... *G03G 15/0881* (2013.01); *G03G 15/0856* (2013.01); *G03G 15/0893* (2013.01); *G03G 15/55* (2013.01)

(58) Field of Classification Search
CPC . G03G 15/50; G03G 15/0881; G03G 15/0882
See application file for complete search history.

(56) References Cited

U.S. PATENT DOCUMENTS 4,999,676 A * 3/1991 Mouri ..... G03G 15/0896 118/689
5,111,247 A * 5/1992 Nichols ..... G03G 15/0849 366/142
8,073,361 B2 12/2011 Oshige
2009/0190960 A1* 7/2009 Hirayama ..... G03G 15/0893 399/256
2011/0286768 A1* 11/2011 Muto ..... G03G 15/0808 399/254

(Continued)

FOREIGN PATENT DOCUMENTS

JP 2000-267424 A 9/2000
JP 2004-252174 A 9/2004
JP 2009-230099 A 10/2009

(Continued)

*Primary Examiner* — Sandra Brase
(74) *Attorney, Agent, or Firm* — Fitzpatrick, Cella, Harper & Scinto

(57) ABSTRACT

An image forming apparatus includes an image bearing member, a developing device, a driving device, and a controller. The developing device includes a developing container, a first feeding member, a second feeding member, a developer carrying member, a content sensor, and a sealing member. Wherein when the controller executes an initializing operation for removing the sealing member from the first opening and the second opening while driving the first feeding member and the second feeding member, the controller provides notification of abnormality when the controller discriminates that an amount of the developer in the second chamber is larger than a predetermined amount at a predetermined timing on the basis of an output of the content sensor.

12 Claims, 17 Drawing Sheets

(56) References Cited

U.S. PATENT DOCUMENTS

| | | | |
|---|---|---|---|
| 2015/0248097 | A1 | 9/2015 | Nose et al. |
| 2016/0004182 | A1 | 1/2016 | Yago et al. |

FOREIGN PATENT DOCUMENTS

| | | | |
|---|---|---|---|
| JP | 2011-232639 | A | 11/2011 |
| JP | 5183103 | B2 | 4/2013 |
| JP | 2014-081665 | A | 5/2014 |

* cited by examiner (a)

(b)

IMAGE FORMING APPARATUS HAVING TONER CONTENT SENSOR

FIELD OF THE INVENTION AND RELATED ART

The present invention relates to an image forming apparatus such as a copying machine, a printer, a facsimile machine or a multi-function machine having a plurality of functions of these machines, and particularly relates to a constitution in which in an initial state of a developing device for forming a circulating path by a first chamber and a second chamber, a developer is sealed in the second chamber.

In an image forming apparatus of an electrophotographic type or an electrostatic recording type, an electrostatic latent image is formed on a surface of an image bearing member such as a photosensitive drum, and the latent image is developed with a toner into a toner image. As a developing device for developing the latent image with the toner, a developing device using a two-component developer containing the toner and a carrier has been conventionally known. Such a developing device includes the first chamber and the second chamber, and the developer is fed and circulated by the first chamber and the second chamber, so that the toner and the carrier are caused to slide with each other to electrically charge the toner. Then, the developer is carried on a developing sleeve as a developer carrying member provided in the first chamber and is fed to a portion opposing the photosensitive drum, so that the latent image on the photosensitive drum is developed with the toner.

As the developing device described above, a developing device in which an initial developer is accommodated in a second chamber and an opening for establishing communication between a first chamber and the second chamber is sealed with a sealing member to seal the developer in the second chamber has been proposed (Japanese Laid-Open Patent Application (JP-A) 2004-252174 and JP-A 2011-232639).

In the developing device including the sealing member, not only the sealing member is removed during initial driving but also the developer is fed by a feeding screw provided in the second chamber. Then, the developer flowing into the first chamber through one opening is fed by a feeding screw provided in the first chamber, so that the developer flows into the second chamber through the other opening. As a result, the developer is circulated between the first chamber and the second chamber. At this time, the developer flowing into the first chamber is carried on the developing sleeve provided in the first chamber.

However, in such a developing device, there is a possibility that the sealing member is not removed normally during the initial driving. Therefore, a constitution in which an image for detection is formed and detected and thus whether or not the sealing member is removed is detected has been proposed (Japanese Patent No. 5183103). Specifically, when the sealing member is removed and the developer flows from the second chamber into the first chamber, the developer can be carried by the developing sleeve disposed in the first chamber and the image for detection can be formed on the photosensitive drum, and therefore when the image for detection is detected, it is possible to discriminate that the sealing member was removed. On the other hand, when the sealing member is not removed and the developer does not flow into the first chamber, the developer is not carried on the developing sleeve and the image for detection is not formed, and therefore when the image for detection is not formed, it is possible to discriminate that the sealing member is not removed.

However, in the case of the constitution disclosed in Japanese Patent No. 5183103, it takes much time until the developer flows from the second chamber into the first chamber and then is carried on the developing sleeve, and thus it takes much time from start of initial driving until whether or not the sealing member is removed is detected. For this reason, even in the case where the sealing member cannot be removed at one opening through which the developer flows from the second chamber into the first chamber, it takes much time until whether or not the sealing member is removed is detected. In this way, when it takes much time until whether or not the sealing member is removed is detected, in the case where the sealing member is not removed, there is a possibility that the developer overflows a developing container in a large amount.

SUMMARY OF THE INVENTION

The present invention is accomplished in view of the above-described circumstances. A principal object of the present invention is to provide an image forming apparatus capable of discriminating whether or not a sealing member sealing an opening is removed and also capable of shortening a time until discrimination is made.

According to an aspect of the present invention, there is provided an image forming apparatus comprising: an image bearing member for bearing an electrostatic latent image; a developing device for developing the electrostatic latent image, borne on the image bearing member, into a toner image with a toner; a driving device for driving the developing device; and a controller for controlling the image forming apparatus, wherein the developing device comprises, a developing container including a first chamber and a second chamber which are capable of accommodating a developer containing a non-magnetic toner and a magnetic carrier, a partition wall for partitioning the first chamber and the second chamber, a first opening, provided upstream of the second chamber with respect to a developer feeding direction, for establishing communication between the first chamber and the second chamber, and a second opening, provided downstream of the second chamber with respect to the developer feeding direction, for establishing communication between the first chamber and the second chamber, a first feeding member for feeding the developer in the first chamber, a second feeding member for feeding the developer in the second chamber in a direction opposite to a direction in the first chamber, a developer carrying member for carrying the developer in the first chamber while rotating and for developing the electrostatic latent image into the toner image with the toner, a content sensor for detecting a toner content in the developing container on the basis of permeability of the developer, and a sealing member for unsealably sealing the first chamber and the second chamber in a state in which the developer is accommodated in the second chamber, wherein when information that the developing device is new is inputted, before an image forming operation is executed, the controller executes an initializing operation for driving the first feeding member and the second feeding member, and wherein the controller provides notification to the effect that the sealing member is not removed on the basis of an output of the content sensor during the initializing operation.

According to another aspect of the present invention, there is provided an image forming apparatus comprising: an image bearing member for bearing an electrostatic latent image; a developing device for developing the electrostatic latent image, borne on the image bearing member, into a toner image with a toner; a driving device for driving the developing device; and a controller for controlling the image forming apparatus, wherein the developing device comprises, a developing container including a first chamber and a second chamber which are capable of accommodating a developer containing a non-magnetic toner and a magnetic carrier, a partition wall for partitioning the first chamber and the second chamber, a first opening, provided upstream of the second chamber with respect to a developer feeding direction, for establishing communication between the first chamber and the second chamber, and a second opening, provided downstream of the second chamber with respect to the developer feeding direction, for establishing communication between the first chamber and the second chamber, a first feeding member for feeding the developer in the first chamber, a second feeding member for feeding the developer in the second chamber in a direction opposite to a direction in the first chamber, a developer carrying member for carrying the developer in the first chamber while rotating and for developing the electrostatic latent image into the toner image with the toner, a content sensor for detecting a toner content in the developing container on the basis of permeability of the developer, and a sealing member for unsealably sealing the first chamber and the second chamber in a state in which the developer is accommodated in the second chamber, wherein when information that the developing device is new is inputted, before an image forming operation is executed, the controller executes an initializing operation for driving the first feeding member and the second feeding member, and wherein the controller provides notification to the effect that a main assembly of the image forming apparatus is abnormal on the basis of an output of the content sensor, and wherein during the initializing operation, when a predetermined first condition is satisfied, the controller provides the notification to the effect that the main assembly is abnormal, and during the image forming operation, when a second condition different from the first condition is certified, the controller provides the notification to the effect that the main assembly is abnormal.

Further features of the present invention will become apparent from the following description of exemplary embodiments with reference to the attached drawings.

DESCRIPTION OF THE EMBODIMENTS

First Embodiment

First Embodiment of the present invention will be described using FIGS. 1 to 13. A general structure of an image forming apparatus in this embodiment will be described using FIG. 1.

Image Forming Apparatus

An image forming apparatus 200 is an example of a full-color image forming apparatus and includes four image forming portions (image forming stations) Sa, Sb, Sc, Sd provided along a rotational direction (arrow R7 direction) of an intermediary transfer belt 7 as an intermediary transfer member. The image forming portions Sa, Sb, Sc, Sd are image forming portions for forming toner images of yellow, magenta, cyan, black, respectively, and include photosensitive drums 1*a*, 1*b*, 1*c*, 1*d*, respectively, which are drum-shaped electrophotographic photosensitive members as image bearing members. In the following, the image forming portions for the respective colors have the same constitution and therefore the image forming portion Sa will be described as a representative, and other image forming portions are shown in the figure by adding corresponding suffixes and will be omitted from description.

Figure 1:
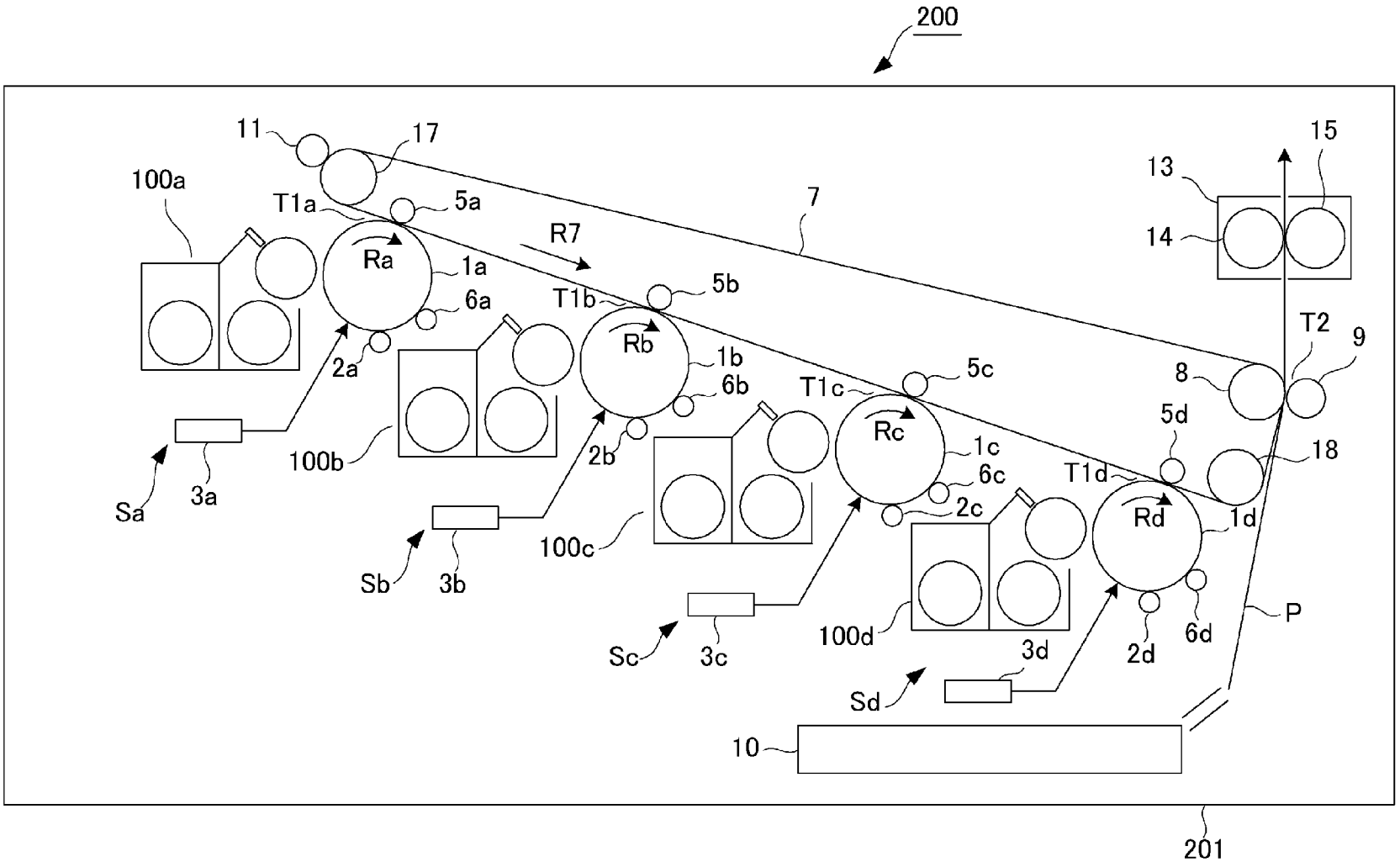
FIG. 1 is a schematic illustration of an image forming apparatus according to a First Embodiment.

The photosensitive drum 1*a* is rotationally driven in an arrow Ra direction (in the clockwise direction in FIG. 1). At a periphery of the photosensitive drum 1*a*, along the rotational direction of the photosensitive drum 1*a*, a primary charger 2*a* (and 2*b*, 2*c* and 2*d*) as a charging means, an exposure device 3*a* (and 3*b*, 3*c* and 3*d*) as a latent image forming means, a developing device 100*a* as a developing means, a primary transfer roller 5*a* (and 5*b*, 5*c* and 5*d*) as a primary transfer means and a secondary charger 6*a* (and 6*b*, 6*c* and 6*d*) as an auxiliary charging means are provided in the listed order.

Around the primary transfer roller 5*a*, a secondary transfer opposite roller 8 and tension rollers 17, 18 and an endless intermediary transfer belt 7 as an intermediary transfer member is extended and stretched. The intermediary transfer belt 7 is urged from a back surface side by the primary transfer roller 5*a*, so that a (front) surface thereof is contacted to the photosensitive drum 1*a*. As a result, between the photosensitive drum 1*a* and the intermediary transfer belt 7, a primary transfer nip T1*a* as a primary transfer portion is formed. The intermediary transfer belt 7 is rotated in the arrow R7 direction with rotation of the secondary transfer opposite roller 8 also functioning as a driving roller. A rotational speed of the intermediary transfer belt 7 is set at a value substantially equal to a rotational speed (process speed) of the above-described photosensitive drum 1*a*.

On the surface of the intermediary transfer belt 7 at a position corresponding to the secondary transfer opposite roller 8, a secondary transfer roller 9 as a secondary transfer means is provided. The secondary transfer roller 9 nips the intermediary transfer belt 7 between itself and the secondary transfer opposite roller 8, so that a secondary transfer nip T2 as a secondary transfer portion is formed between the secondary transfer roller 9 and the intermediary transfer belt 7. Further, on the surface of the intermediary transfer belt 7, at a position corresponding to the tension roller 17, a belt cleaner 11 as an intermediary transfer member cleaner is contacted to the intermediary transfer belt 7.

A recording material (e.g., a sheet material such as paper or an OHP sheet) P subjected to image formation is accommodated in a cassette 10 in a stacked state. The recording material P is supplied to the above-described secondary transfer nip T2 by a feeding and conveying device including a feeding roller, a conveying roller, a registration roller and the like which are not shown in FIG. 1. In a side downstream of the secondary transfer nip T2 along a feeding direction of the recording material P, a fixing device 13 including a fixing roller 14 and a pressing roller 15 is pressed against the fixing roller 14, and in a side downstream of the fixing device 13, a (sheet) discharge tray (not shown) is provided.

In the image forming apparatus 200, a full-color toner image is formed in the following manner. First, when an original is read by an unshown scanner, an image signal consisting of components of yellow, magenta, cyan, black is determined. In some cases, the image signal is also sent from an external terminal such as a personal computer. Then, the photosensitive drum 1*a* is rotationally driven in the arrow direction at a predetermined process speed by a photosensitive drum driving motor (not shown), and is electrically charged uniformly to a predetermined polarity and a predetermined potential by the primary charger 2*a*. The photosensitive drum 1*a* after the charging is exposed to light on the basis of image information, so that electric charges at an exposed portion are removed and thus an electrostatic latent image corresponding to each of the colors is formed.

The electrostatic latent images on the photosensitive drums 1*a*, 1*b*, 1*c*, 1*d* are developed as toner images of the respective colors of yellow, magenta, cyan, black, respectively, by the developing devices 100*a*, 100*b*, 100*c*, 100*d*. These four color toner images are successively primary-transferred onto the intermediary transfer belt 7 at the primary transfer nips T1*a*, T1*b*, T1*c*, T1*d* by the primary transfer rollers 5*a*, 5*b*, 5*c*, 5*d*, respectively. Thus, the four color toner images are superposed on the intermediary transfer belt 7. Toners remaining on the photosensitive drums 1*a*, 1*b*, 1*c*, 1*d* are collected in developing containers 101 of the developing devices 100*a*, 100*b*, 100*c*, 100*d*, respectively.

In the above-described manner, the four color toner images superposed on the intermediary transfer belt 7 are secondary-transferred onto the recording material P. The recording material P fed from the cassette 10 by the feeding and conveying device is supplied to the secondary transfer nip T2 so as to be timed to the toner images on the intermediary transfer belt 7 by the registration roller. Onto the supplied recording material P, at the secondary transfer nip T2, the four color toner images are collectively secondary-transferred by the secondary transfer roller 9.

The recording material P on which the four color toner images are secondary-transferred is conveyed to the fixing device 13, where the recording material P is heated and pressed, so that the toner images are fixed on the surface thereof. The recording material P after the toner images are fixed is discharged on the discharge tray (not shown). By the above operation, full-color image formation on one surface (front surface) of a single sheet of the recording material P is ended.

Developing Device

Figure 2:
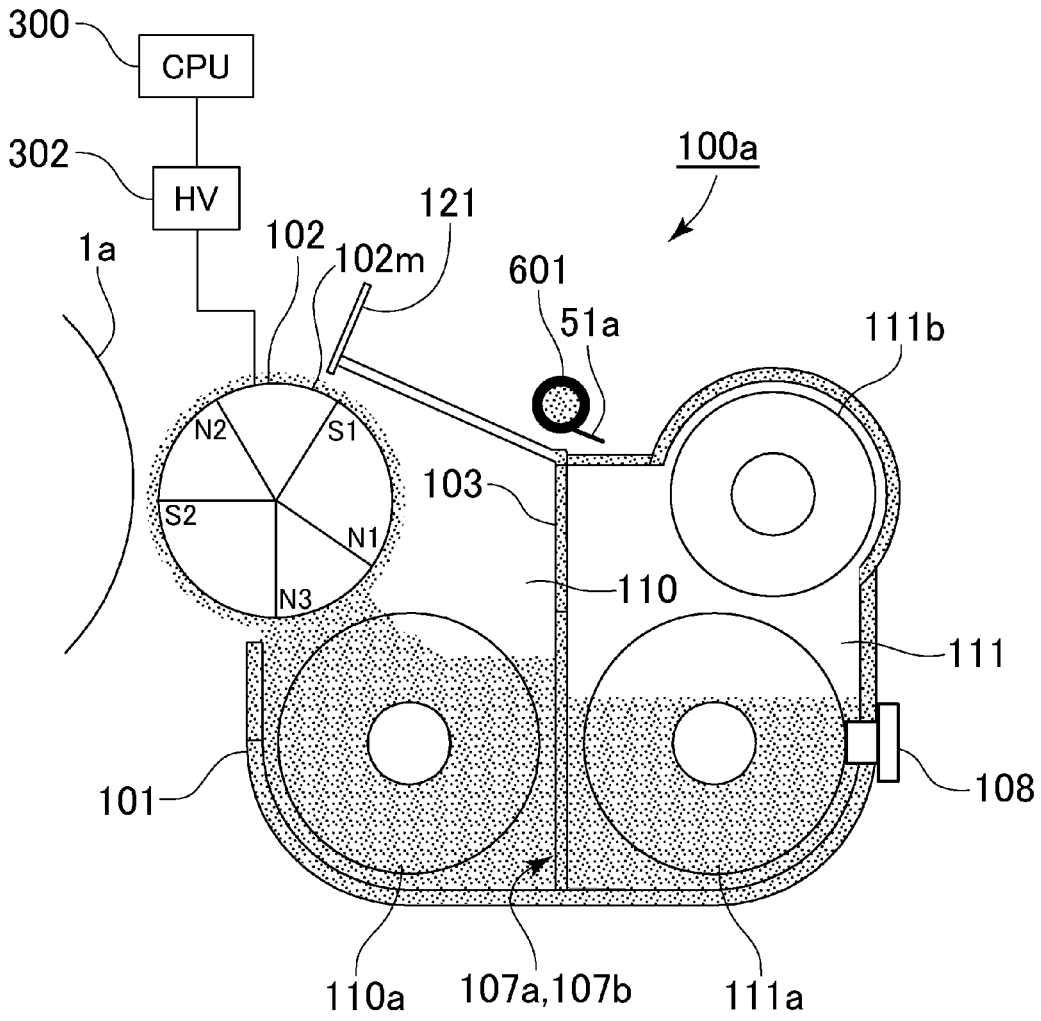
FIG. 2 is a schematic cross-sectional view showing a structure of a developing device in the First Embodiment.
Figure 3:
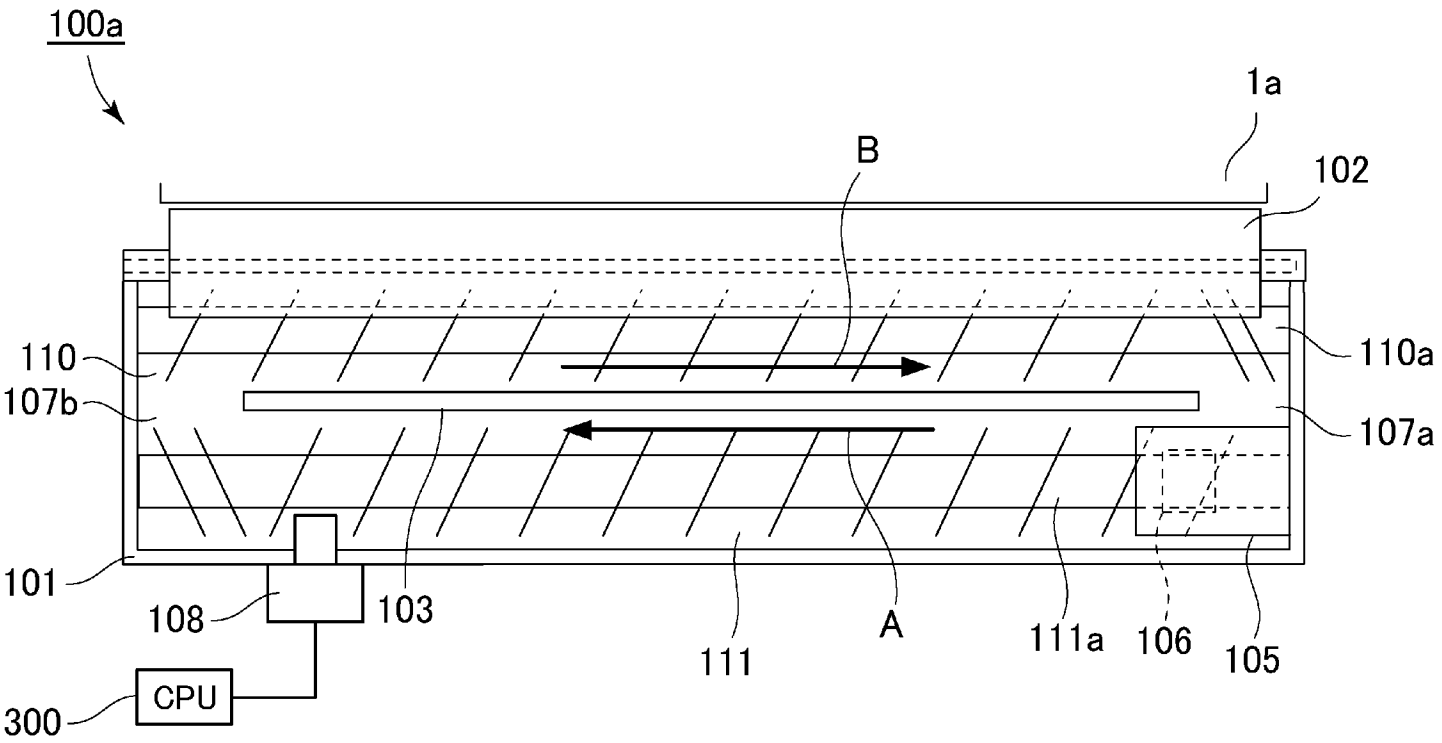
FIG. 3 is a schematic longitudinal sectional view showing the structure of the developing device in the First Embodiment.

The developing devices 100*a*, 100*b*, 100*c*, 100*d* in this embodiment will be described using FIGS. 2 to 5. The developing devices for the respective colors have the same constitution except that developers accommodated therein are different from each other and therefore in the following, the developing device 100*a* of the image forming portion Sa will be described as a representative. As shown in FIGS. 2 and 3, the developing device 100*a* includes the developing container 101. At an opening of the developing container 101 at a position opposing and close to the develop 1*a*, a cylindrical developing sleeve 102 as a developer carrying member is provided.

Inside the developing container 101, a developing chamber 110 as a first chamber and a stirring chamber 111 are partitioned so as to be parallel to each other. A partitioning wall 103 as a partition wall partitions between the developing chamber 110 and the stirring chamber 111. Inside the developing chamber 110 (first chamber), a first stirring screw 110*a* as a first feeding member is mounted rotatably. Inside the stirring chamber 111 (second chamber), a second stirring screw 111*a* as a second feeding member is mounted rotatably. Each of the first stirring screw 110*a* and the second stirring screw 111*a* is provided with a helical blade on a rotation shaft thereof.

Each of the developing chamber 110 and the stirring chamber 111 is constituted so that a two-component developer containing a non-magnetic toner, a magnetic carrier and a small amount of an external additive in mixture can be accommodated. When the second stirring screw 111*a* rotates, the two-component developer is fed from an upstream side toward a downstream side of the stirring chamber 111 as shown by an arrow A. When the first stirring screw 110*a* rotates, the two-component developer is fed from an upstream side toward a downstream side of the developing chamber 110 as shown by an arrow B. That is, the second stirring screw 111*a* feeds the developer in the stirring chamber 111 in an opposite direction to the direction in the developing chamber 110.

In upstream side and downstream side of the partitioning wall 103 with respect to the developer feeding direction of the second stirring screw 111*a*, a first opening 107*a* and a second opening 107*b* are formed, respectively. As a result, the developing chamber 110 and the stirring chamber 111 communicate with each other through the first opening 107*a* and the second opening 107*b*, so that a circulation path for the developer is formed. That is, a delivery of the developer from the developing chamber 110 to the stirring chamber 111 is made through the opening 107*a*, and a delivery of the developer from the stirring chamber 111 to the developing chamber 110 is made through the second opening 107*b*.

The developer is fed toward the downstream side of the stirring chamber 111 while being stirred inside the stirring chamber 111 by the second stirring screw 111*a*, and thereafter passes through the second opening 107*b* free from the partitioning wall 103 to flow into the developing chamber 110. Then, the developer is carried on the developing sleeve 102 in a process in which the developer is fed inside the developing chamber 110 toward the downstream side of the developing chamber 110 by the first stirring screw 110*a*. In a process in which the developer is circulated along the above-constituted circulation path while being stirred, toner particles and carrier particles are triboelectrically charged with each other, so that the toner is charged to a negative polarity and the carrier is charged to a positive polarity.

The developing sleeve 102 described above rotates while carrying the developer in the developing container 110 and develops the electrostatic latent image, borne on the photosensitive drum 1*a*, with the toner into the toner image. At a periphery of the developing sleeve 102, at an upstream of a developing region where the developing sleeve 102 opposes the photosensitive drum 1*a* with respect to the rotational direction, a layer thickness regulating blade 121 is provided, so that a layer thickness of the developer carried by the developing sleeve 102 is regulated.

Inside the developing sleeve 102, a magnet 102*m* which has a plurality of magnetic poles at a surface thereof and which is supported non-rotatably is provided. The developer is carried on the surface of the developing sleeve 102 in a state in which the carrier as a magnetic material is constrained by a magnetic flux formed between adjacent magnetic poles of the magnet 102*m*, so that the negatively charged toner is constrained electrostatically on the surface of the positively charged carrier to form a magnetic brush. A CPU 300 as a control means for controlling the image forming apparatus 200 applies, from a power (voltage) source 302 to the developing sleeve 102, an oscillating voltage in the form of a negative DC voltage biased with an AC voltage, so that the toner which is negatively charged and which is carried on the magnetic brush is transferred onto the electrostatic latent image.

Above the stirring chamber 111 in the upstream side with respect to the developer feeding direction, a toner supplying mechanism 105 is provided. The toner accommodated in an unshown toner bottle is fed to the toner supplying mechanism 105, along an unshown toner feeding path and passes through a toner supplying opening 106 and then falls into the stirring chamber 111 to be supplied. In the case of this embodiment, as described later using FIGS. 4 and 5, in the stirring chamber 111, a third stirring screw 111*b* is provided above the second stirring screw 111*a*. During actuation of the developing device 100*a* from an initial state described later, the developer sealed in the stirring chamber 111 is fed in an opposite direction (C direction) to the developer feeding direction (A direction) of the second stirring screw 111*a*, so that the developer is circulated in the stirring chamber 111.

In the developing device 100*a* in this embodiment, as a toner for supply, the toner of the same type as that of the toner in an initial developer was used. Here, in the two-component developer using the toner and the carrier, a toner charge amount and a toner proportion contained in the two-component developer ("T/D", i.e., a toner content (concentration)) have a correlation. The toner is charged by frictional control with the carrier, and therefore the toner charge amount becomes larger with an increasing opportunity of the contact of the toner with the carrier. Accordingly, the toner charge amount becomes larger with a smaller toner content and becomes smaller with a larger toner content. For this reason, the toner content of the developer circulating between the developing chamber 110 and the stirring chamber 111 is detected using an inductance sensor 108 as a content detecting means. The CPU 300 adjusts a toner supply amount from the toner supplying mechanism 105 so as to provide a proper toner charge amount, on the basis of a detection result of the inductance sensor 108, thus adjusting the toner content.

The inductance sensor 108 for detecting the toner content in the developing container 101 will be described using FIGS. 4 and 5. The inductance sensor 108 is provided at a position opposing the second stirring screw 111*a* in the stirring chamber 111 as shown in FIGS. 2 and 3. Particularly, in this embodiment, the inductance sensor 108 is disposed on a container side surface in the downstream side, of the second stirring screw 111*a* with respect to the developer feeding direction, where the supply toner is sufficiently stirred in the stirring chamber 111. The inductance sensor 108 may also be disposed in the upstream side of the stirring chamber 111. As a result, whether or not a sealing sheet 51*a* for sealing the first opening 107*a* provided in the upstream side of the stirring chamber 111 is removed can be detected as early as possible as described later.

Figure 4:
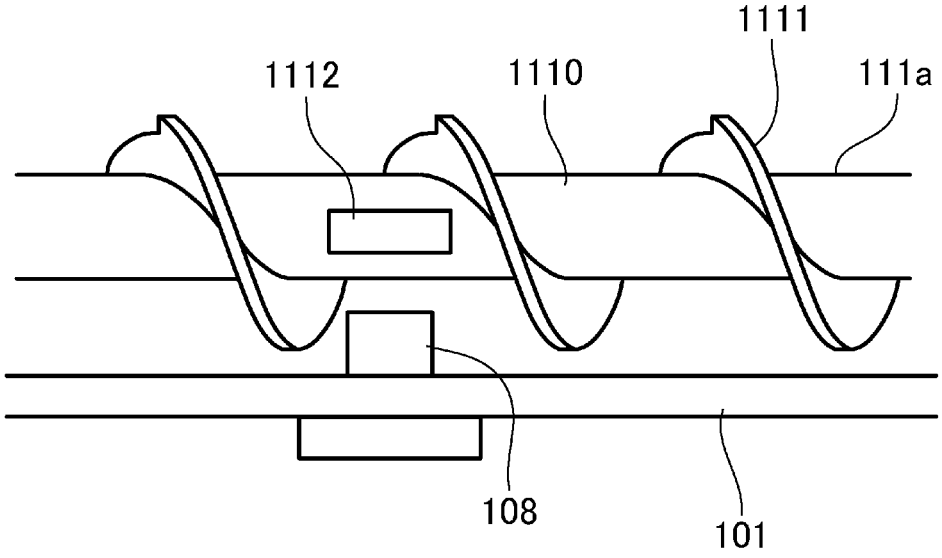
FIG. 4 is a schematic enlarged view showing a part of a second sealing sheet opposing an inductance sensor.

The second stirring screw 111*a* includes, as shown in FIG. 4, a helical blade 1111 and a plurality of stirring ribs 1112 on a rotation shaft 1110. The inductance sensor 108 is disposed opposed to the stirring rib 1112. As a result, a stirring property of the developer in the neighborhood of the inductance sensor 108 is improved. That is, at a periphery of the inductance sensor 108, the developer does not readily stagnate, but when replacement of the developer is not properly performed at the periphery of the inductance sensor 108, the toner content cannot be detected accurately. For this reason, in this embodiment, the second stirring screw 111*a* is provided with the stirring rib 1112 at a position opposing the inductance sensor 108, so that the developer stirring property is improved.

Such an inductance sensor 108 detects the toner content from (magnetic) permeability of the developer. That is, an output voltage varies depending on the permeability. As described above, the carrier is a magnetic member (material) and the toner is a non-magnetic member (material), and therefore the toner content can be detected by detecting the permeability. Further, the output voltage of the inductance sensor 108 fluctuates depending on a bulk density of the developer. Accordingly, when the second stirring screw 111*a* rotates, the bulk density varies depending on a rotation period (cycle), and therefore there is a characteristic that the output voltage has an amplitude with the rotation period of the second stirring screw 111*a*.

Figure 5:
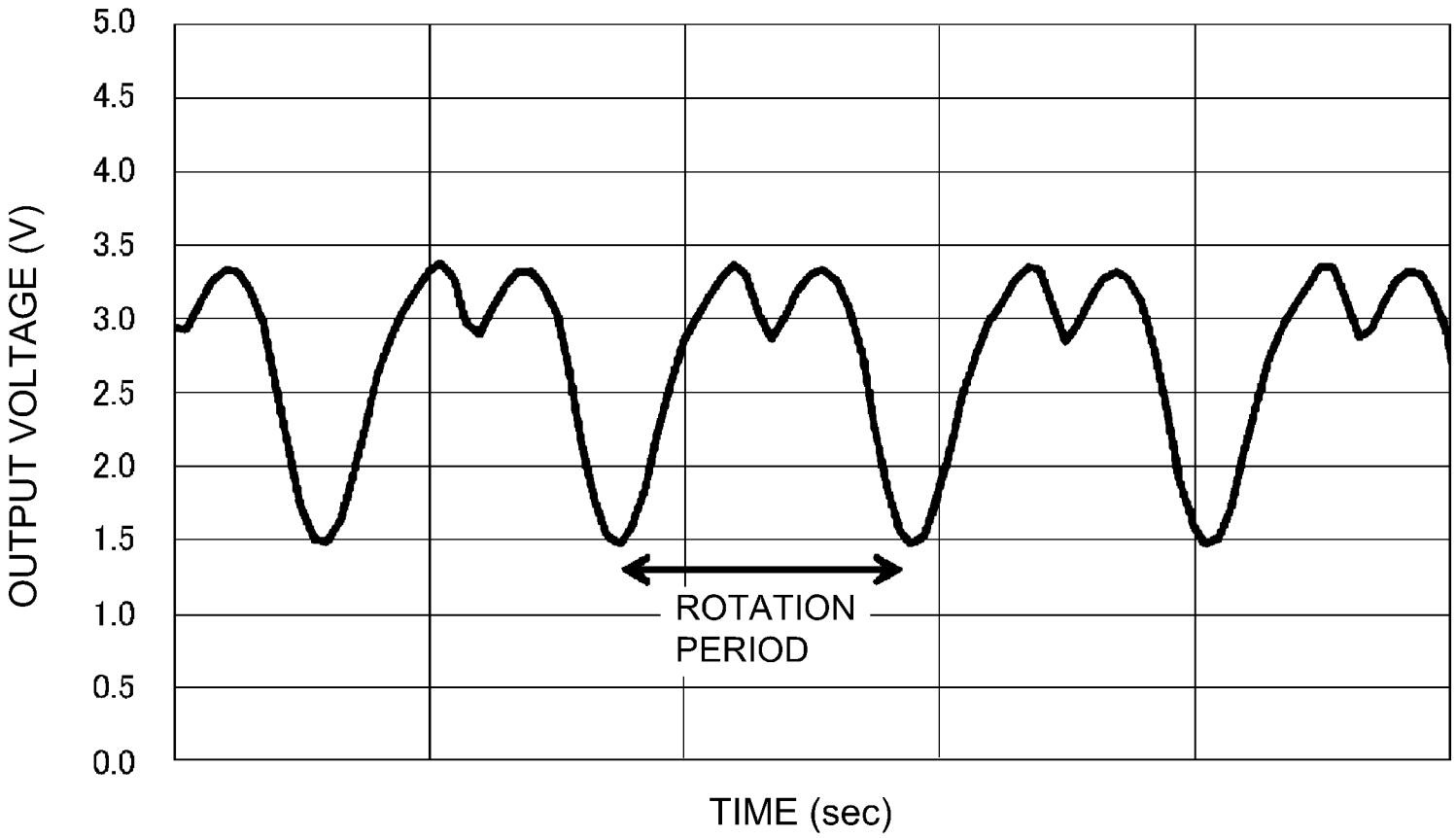
FIG. 5 is a graph showing time progression of an output waveform of the inductance sensor in the First Embodiment.

FIG. 5 shows an output waveform of the inductance sensor 108 when the toner content in the developing container 101 is constant. As shown in FIG. 5, the bulk density of the developer fluctuates with the rotation period of the second stirring screw 111*a*, and therefore the output voltage of the inductance sensor 108 also fluctuates with the rotation period of the second stirring screw 111*a* to form a peak-to-peak state.

Sealing Structure and Sealing Removal Structure of Initial Developer

Figure 6:
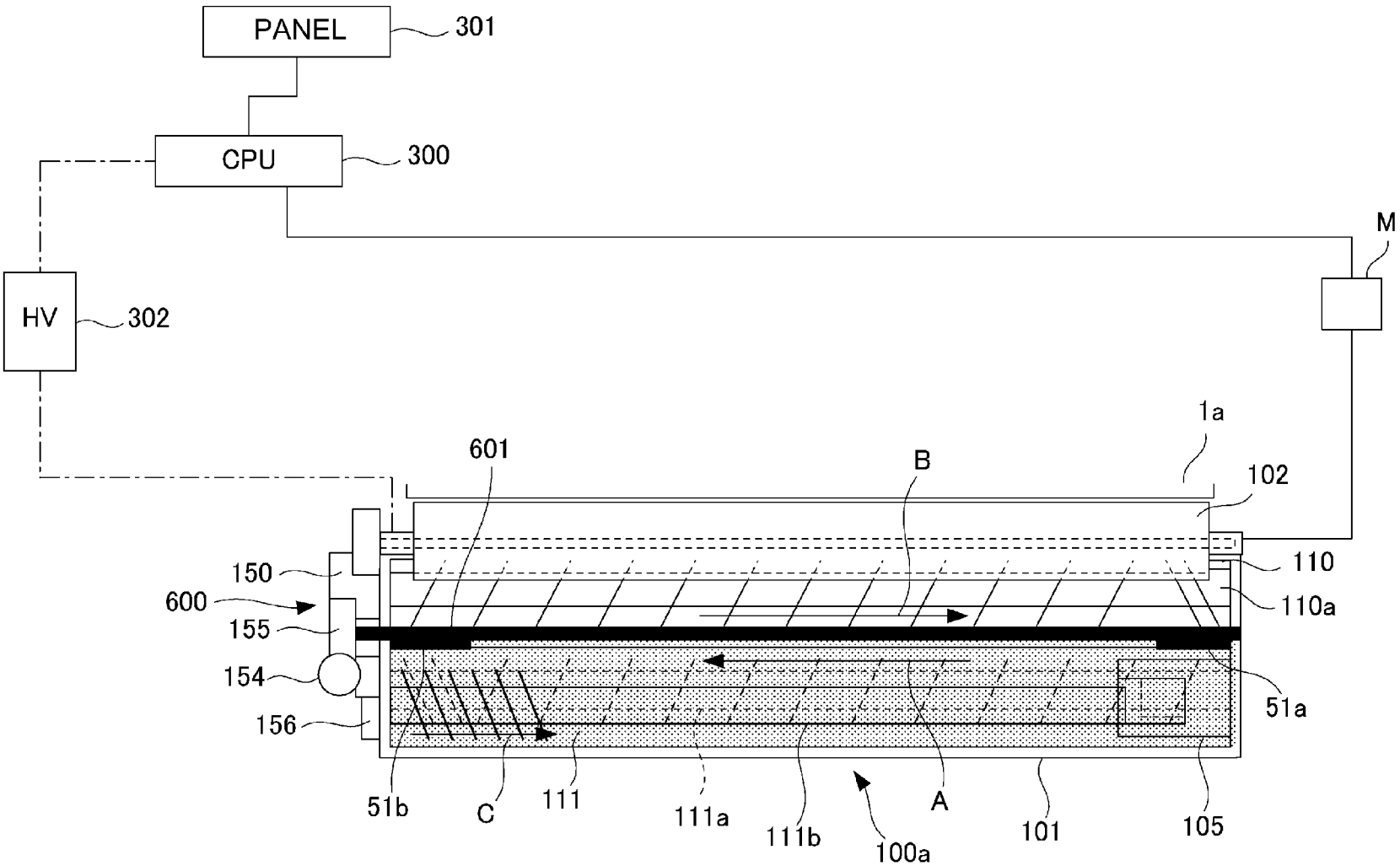
FIG. 6 is a schematic view of a combination of a schematic longitudinal sectional view of the developing device in an initial state with a control block diagram in the First Embodiment.
Figure 7:
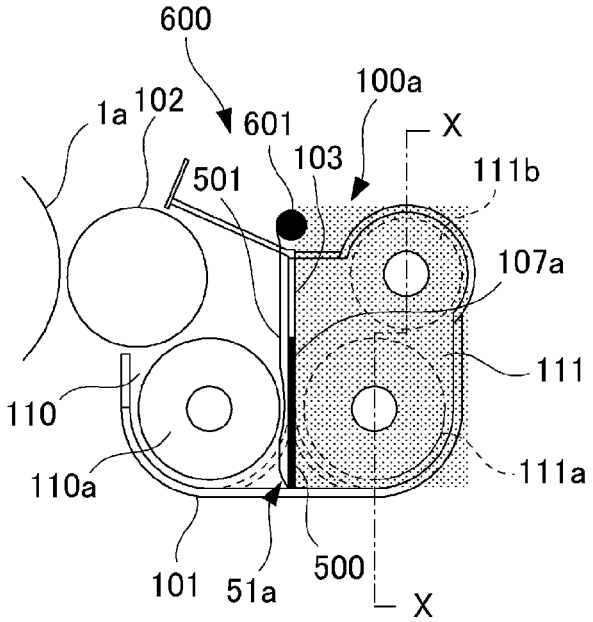
In FIG. 7, (a) is a schematic cross-sectional view of the developing device in the initial state in the First Embodiment, and (b) is a sectional view taken along X-X line in (a) of FIG. 7.
Figure 7:
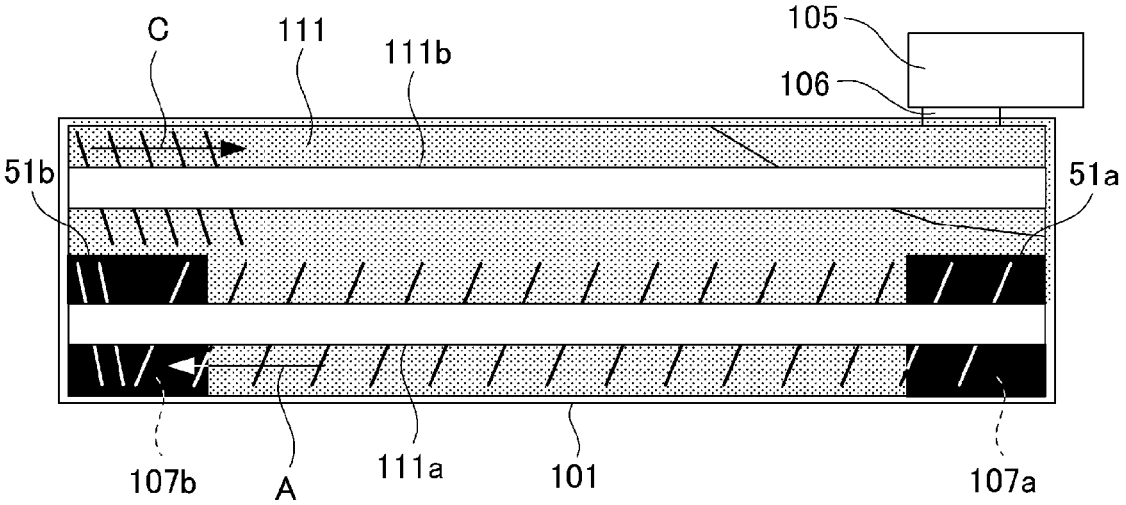
Figure 8:
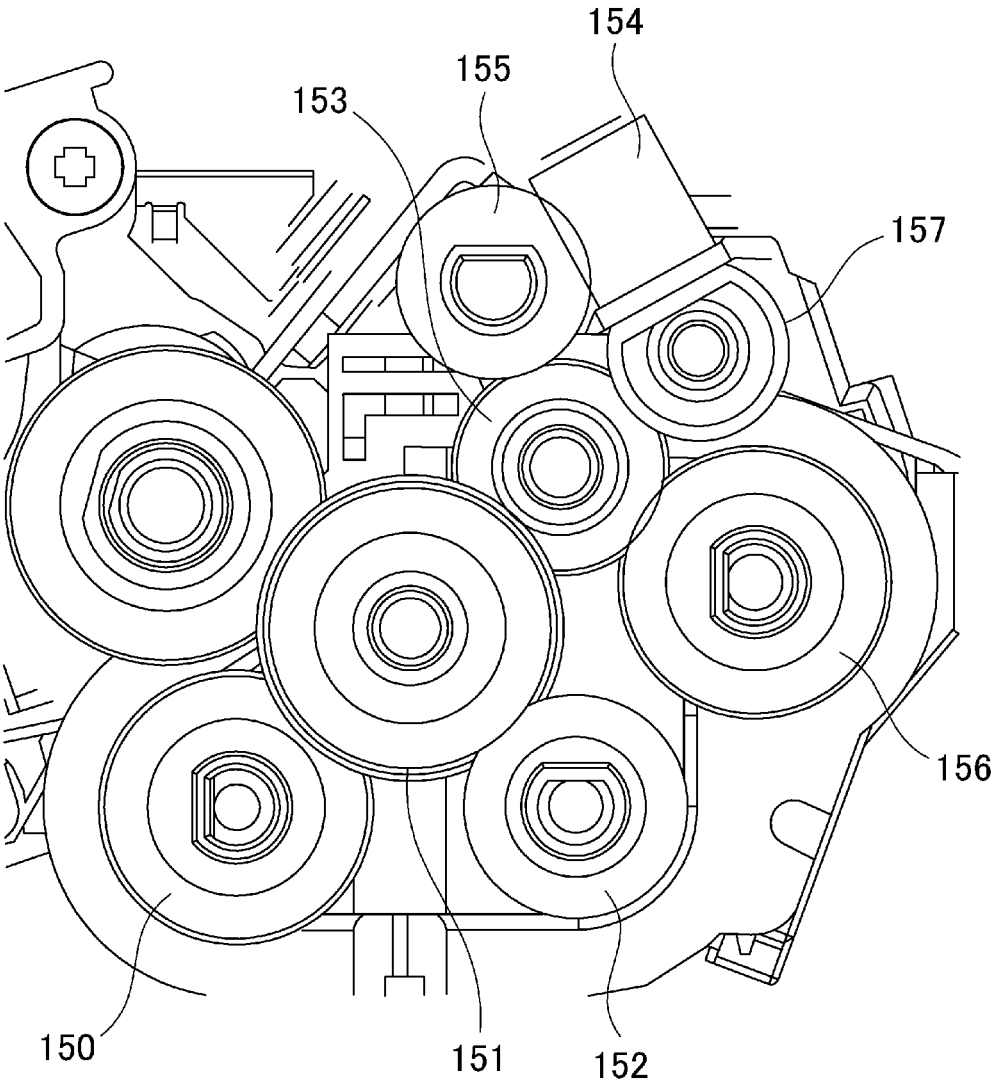
FIG. 8 is a schematic side view showing a structure of a drive transmitting portion of the developing device in the First Embodiment.

A sealing structure and a sealing removal structure of an initial developer in this embodiment will be described using FIGS. 6 to 8. In the case of this embodiment, the developing device 100*a* is detachably mountable to an apparatus main assembly 201 (FIG. 1) of the image forming apparatus 200 and is exchangeable. For this reason, for example, in combination with the photosensitive drum 1*a*, the primary charger 2*a* and the like, the developing device 100*a* chambers a process cartridge detachably mountable to the apparatus main assembly 201. Incidentally, only the developing device 100*a* separately from these members may constitute a toner cartridge detachably mountable to the apparatus main assembly 201. In either case, in a brand-new state (initial state) such as a state immediately after exchange of the developing device 100*a*, as shown in FIGS. 6 and 7, the developer (dotted portion) is sealed in the stirring chamber 111. Also during shipping of the image forming apparatus 200, the developer is similarly sealed in the stirring chamber 111 of the developing device 100*a* disposed in the apparatus main assembly 201.

In the state in which the developer is sealed in the stirring chamber 111, the first opening 107*a* and the second opening 107*b* for establishing communication between the developing chamber 110 and the stirring chamber 111 are covered with sheet-shaped sealing sheets 51*a* and 51*b*, respectively, which are sealing members. That is, the sealing sheet 51*a* is bonded to a periphery of the first opening 107*a* of the partitioning wall 103, and seals the first opening 107*a* in the upstream side of the second stirring screw 111*a* with respect to the developer feeding direction. On the other hand, the sealing sheet 51*b* is bonded to a periphery of the second opening 107*b* of the partitioning wall 103, and seals the second opening 107*b* in the downstream side of the second stirring screw 111*a* with respect to the developer feeding direction. By such a sealing structure, in an initial state of the developing device 100*a* before initial driving of the developing device 100*a*, the developer is filled only in the stirring chamber 111, so that both of the carrier and the toner of the developer do not exist inside the developing container 110. Incidentally, the initial driving of the developing device 100*a* refers to the case where the developing device 100*a* is first driven after the image forming apparatus 200 in which a new developing device 100*a* is mounted in advance is installed or after the new developing device 100*a* is mounted in the apparatus main assembly 201.

The first opening 107*a* and the second opening 107*b* sealed (covered) with the sealing sheets 51*a* and 51*b*, respectively, open in a substantially rectangular shape. As described later, the sealing sheets 51*a*, 51*b* are removed by being peeled off in an upward direction (removing direction) in (a) of FIG. 7, but the first and second openings 107*a*, 107*b* are formed in the substantially rectangular shape having sides substantially parallel to the removing direction. Each of the sealing sheets 51*a*, 51*b* is bonded to the 4 sides of the periphery (the entire periphery) of the associated first or second opening 107*a* or 107*b* so as to surround the associated opening. Incidentally, the bonding of the sealing sheets 51*a*, 51*b* to the partitioning wall 103 may also be performed by melting a bonding portion of the sealing sheets 51*a*, 51*b* by heat (welding) or the like. In summary, it is only required that the first and second openings 107*a*, 107*b* are hermetically sealed with the sealing sheets 51*a*, 51*b*, respectively. In this embodiment, by the following constitution, the CPU 300 discriminates whether the apparatus main assembly is in a state during initial driving or in another state (e.g., during image formation). First, the apparatus main assembly is provided with an unshown display portion (operating portion). Then, in the case of initial installation of the apparatus main assembly or in the case where the developing device 100*a* is replaced with a new developing device, a service person or a user presses an initial button provided at the display portion, so that an initializing signal is inputted into the CPU 300. The CPU 300 performs a predetermined initializing operation (initial driving) on the basis of the initializing signal inputted from the operating portion. In the initializing operation in this embodiment, the first and second stirring screws 110*a*, 110 are driven and a patch image for controlling an image forming condition is detected. In addition, such an operation that a control voltage of a patch detecting sensor for detecting the patch image or the inductance sensor 108 is determined is performed. In this way, the CPU 300 can discriminate whether or not the apparatus main assembly is in the state during the initial driving. A constitution in which in place of the initializing signal, a new article detecting means for detecting whether or not the developing device is new is provided and then the initializing operation is executed may also be employed.

Next, the sealing removal structure for removing the sealing sheets 51*a*, 51*b* as described above will be described. A basic constitution for removing each of the sealing sheets 51*a*, 51*b* is the same, and therefore in the following, the sealing sheet 51*a* will be described as a representative. As shown in (a) of FIG. 7, the sealing sheet 51*a* includes a sealing portion 500 for covering the first opening 107*a* by being bonded to the partitioning wall 103 between one end portion to an intermediary portion thereof and includes a folded-back portion 501 folded back from the other end portion of the sealing portion 500.

On the other hand, a winding-up device 600 as a removing means for removing the sealing sheet 51*a* includes a winding-up shaft 601 as a winding-up portion. To the winding-up shaft 601, an end portion of the folded-back portion 501 in a side opposite from the sealing portion 500 is connected. The winding-up shaft 601 is rotated to wind up the sealing sheet 51*a* from the folded-back portion 501, so that the sealing portion 500 is peeled off from the first opening 107*a*.

Here, a single winding-up shaft 601 is disposed for a single developing device 101*a* and winds up the two sealing sheets 51*a*, 51*b* for sealing the first and second openings 107*a*, 107*b*, respectively, formed in the partitioning wall 103. That is, also the folded-back portion 501 of the sealing sheet 51*b* is connected to the winding-up shaft 601. By rotation of the winding-up shaft 601, each of the sealing sheets 51*a*, 51*b* is wound up from the associated folded-back portion 501, so that the associated sealing portion is peeled off from the associated one of the first and second openings 107*a*, 107*b*.

In this embodiment, in order to wind up the sealing sheets 51*a*, 51*b* about the winding-up shaft 601, as the sealing sheets 51*a*, 51*b*, about a 0.1 mm-thick thin plate (sheet) of a resin material containing polyester was used, for example. The material and the shape for the sealing sheets 51*a*, 51*b* are not limited to those described in this embodiment. As each of the sealing sheets 51*a*, 51*b*, it is preferable that a film including a base material of polyester, nylon, polyethylene or the like and having a lamination structure formed by lamination in a thickness of about 100-200 μm.

The winding-up shaft 601 rotating for winding-up the sealing sheets 51*a*, 51*b* as described above is, as shown in FIG. 6, driven by a driving motor M as a driving means for driving the developing device 100*a*. Here, the developing sleeve 102, the first stirring screw 110*a*, the second stirring screw 111*a*, the third stirring screw 111*b* and the winding-up shaft 601 which constitute the developing device 100*a* are connected by a gear train shown in FIG. 8. The driving motor M is connected with the rotation shaft of the developing sleeve 102 as shown in FIG. 6. To the developing sleeve 102, a developing bias is applicable by a high-voltage source (HV) 302. Each of the driving motor M and the high-voltage source 302 is controlled in accordance with an instruction from the CPU 300. The CPU 300 operates respective portions of the image forming apparatus 200 depending on an operation of an operating panel 301 provided as the operating portion on the apparatus main assembly 201.

During the initial driving of the developing device 100*a*, by the instruction from the CPU 300, when the driving motor M is rotated, a rotational force is transmitted to the respective portions via the gear train. That is, the developing device 100*a* is connected with the driving motor M provided in the apparatus main assembly 201 side of the image forming apparatus 200 via a coupling (not shown) detachably mountable to the developing sleeve 102 in an axial direction of the developing sleeve 102. The driving motor M is controlled by an instruction from the CPU 300 to rotationally drive the developing sleeve 102. The rotation of the developing sleeve 102 is distributed by the gear train disposed in a side opposite from a side where the driving motor M is connected to the developing sleeve 102, so that the second stirring screw 111*a*, the first stirring screw 110*a*, the winding-up shaft 601 and the third stirring screw 111*b* are integrally rotated. When the developing sleeve 102 is rotated, a center gear 151 is rotated. A gear 150 engaging with the gear 151 rotates the first stirring screw 110*a*. A gear 152 engaging with the gear 151 rotates the second stirring screw 111*a*.

Through engagement among the gears 151, 153, 156, the third stirring screw 111*b* is rotated. Through engagement among the gears 151, 153, 157, 154, 155, the winding-up shaft 601 is rotated. In order to ensure a torque necessary when the winding-up shaft 601 peels off the sealing sheets 51*a*, 51*b*, the gears 154, 155 are configured to largely reduce a speed using a warm gear.

The numbers of rotations of the respective gears are set so that the developing sleeve 102 rotates at 250 rpm, the first stirring screw 100*a* rotates at 300 rpm, the second stirring screw 111*a* rotates at 400 rpm, and the third stirring screw 111*b* rotates at 300 rpm. Further, the winding-up shaft 601 is set so as to rotate at 20 rpm, for example. In this way, a stirring force of the second stirring screw 111*a* is set at a value larger than a stirring force of the first stirring screw 110*a*. Connection between the winding-up shaft 601 and the gear 155 is made at a position close to the sealing sheet 51*b*, of the sealing sheets 51*a*, 51*b*, started to be peeled off earlier than the sealing sheet 51*a* as described later. In this embodiment, the winding-up shaft 601 is rotated as described above by the driving motor M, so that removal of the sealing sheets 51*a*, 51*b* is made automatically.

Next, peeling-off start timing of the two sealing sheets 51*a*, 51*b* in the developing device 100*a* will be described. As described above, in the developing device 100*a* in the initial state, the developer is sealed in the stirring chamber 111, so that there is no developer in the developing container 110. For this reason, during the initial driving (initial actuation) of the developing device 100*a*, the sealing sheets 51*a*, 51*b* are wound up by rotating the above-described winding-up shaft 601, so that the sealing sheets 51*a*, 51*b* are removed from the first and second openings 107*a*, 107*b*, respectively. Thus, the developing chamber 110 and the stirring chamber 111 are caused to communicate with each other, so that the developer moves into the developing chamber 110. That is, during use of the developing device 110*a*, a circulation path of the developer is formed by the developing chamber 110 and the stirring chamber 111.

The sealing sheets 51*a*, 51*b* are bonded to the partitioning wall 103, and therefore when start timing and end timing of the peeling-off of the seal portions 500 of the respective sheets overlap with each other, a load exerted on the driving motor M becomes large. For this reason, in this embodiment, the peeling-off start timing and the peeling-off end timing of the sealing sheet 51*a* are prevented from overlapping with those of the sealing sheet 51*b*, respectively. Specifically, the peeling-off of the sealing sheet 51*b* for sealing the second opening 107*b* in the downstream side of the second stirring screw 111*a* with respect to the developer feeding direction is started earlier than the peeling-off of the sealing sheet 51*a* for sealing the first opening 107*a* in the upstream side of the second stirring screw 111*a* with respect to the developer feeding direction. For this reason, the folded-back portion 501 of the sealing sheet 51*b* is made shorter than the folded-back portion 501 of the sealing sheet 51*a*. In other words, a length from a portion where the sealing sheet 51*a* is folded back, from the sealing portion 500, to the winding-up shaft 601 is made longer than a length from a portion where the sealing sheet 51*b* is folded back, from the sealing portion 500, to the winding-up shaft 601.

In the case where the developing device 100*a* is operated in a state in which the sealing sheets 51*a*, 51*b* are sealed between the developing chamber 110 and the stirring chamber 111 and thus the initial developer is hermetically sealed and stored in the stirring chamber 111, the load on the driving motor M becomes large. Particularly, when the second stirring screw 111*a* is continuously rotated in a state in which the sealing sheet 51*a* is not removed, the developer cannot be moved from the stirring chamber 111 to the developing chamber 110, and therefore a driving load of the developing device 100*a* becomes very large. Accordingly, the peeling-off start timing of the sealing sheet 51*b* is made earlier than the peeling-off start timing of the sealing sheet 51*a*.

Winding-Up of Sealing Sheets During Initial Installation of Developing Device Next, winding-up of the sealing sheets 51*a*, 51*b* during initial installation of the developing device 100*a* will be described. As described above, the initial driving of the developing device 100*a* is made after the image forming apparatus 200 in which the new developing device 100*a* is mounted in advance or after the new developing device 100*a* is mounted in the apparatus main assembly 201. During this initial driving, not only the feeding of the developer is started by driving the first and second stirring screws 107*a*, 107*b* by the driving of the driving motor M but also the winding-up of the sealing sheets 51*a*, 51*b* is started from the sealing sheet 51*b* by rotating the winding-up shaft 601. That is, during the initial driving of the developing device 100*a*, also the winding-up device 600 as the removing means is driven by the driving motor M.

Figure 9:
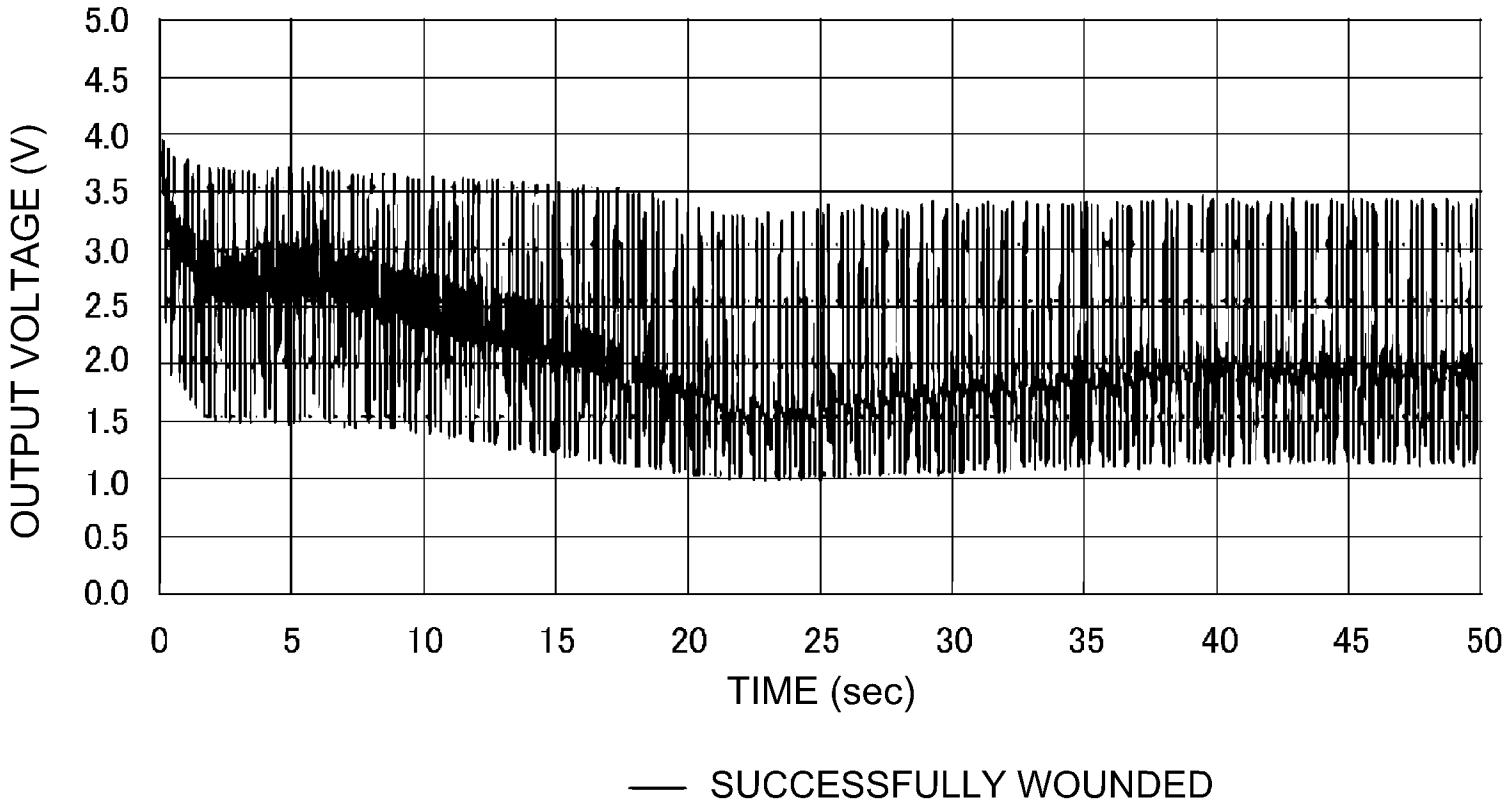
FIG. 9 is a graph showing time progression of an output waveform of the inductance sensor in the case where winding-up of a sealing sheet succeeded.

In this case, a time progression of an output waveform of the inductance sensor 108 when the winding-up of both of the sealing sheets 51*a*, 51*b* succeeded is shown in FIG. 9. FIG. 9 shows the time progression in the case where the winding-up of the two sealing sheets 51*a*, 51*b* from the winding-up start timing of the sealing sheet 51*b* is ended and the winding-up of both of the two sealing sheets 51*a*, 51*b* succeeded. In this case, a time progression of a movement average value of an output of the inductance sensor 108 is shown in FIG. 10.

Figure 10:
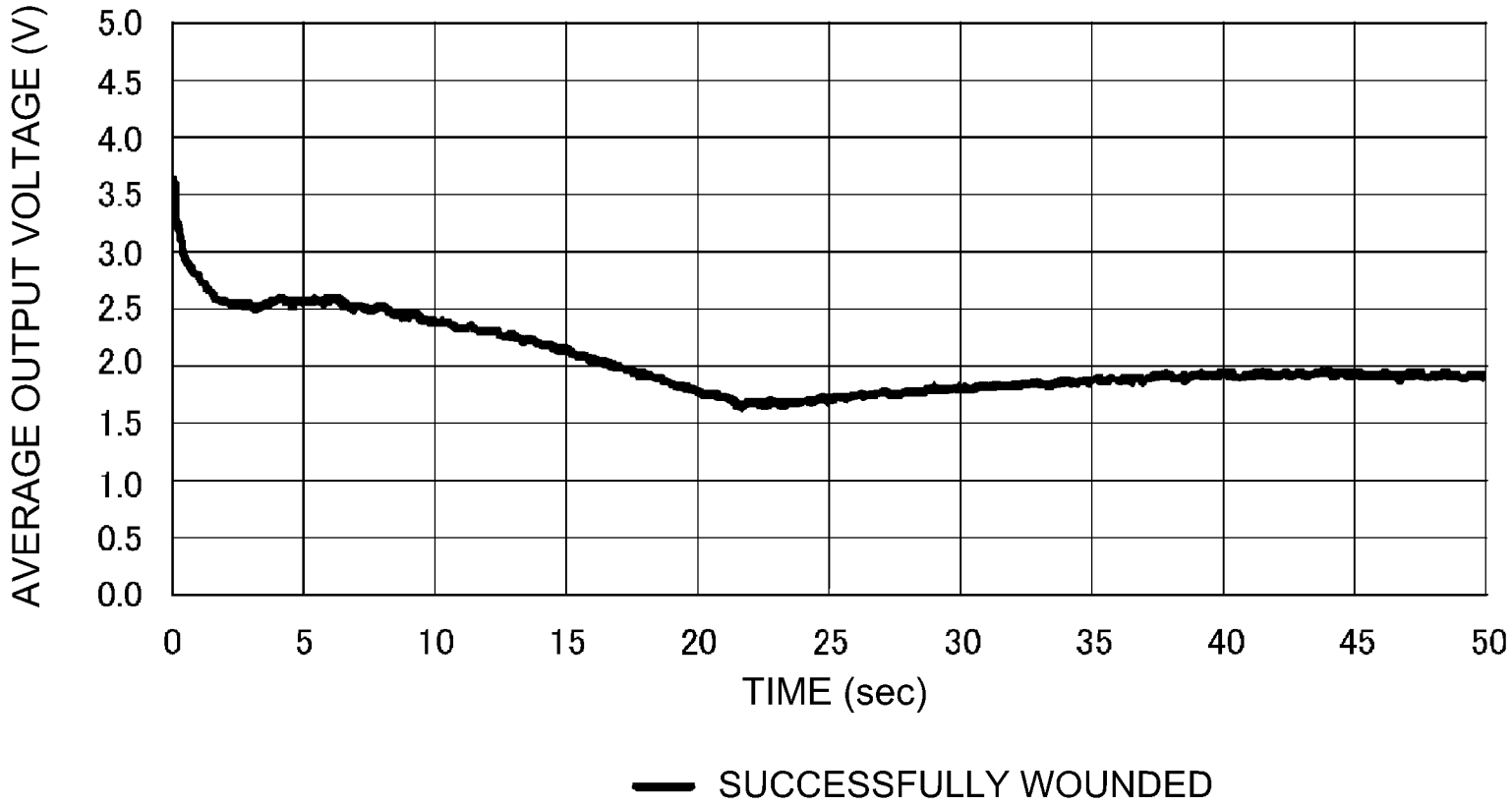
FIG. 10 is a graph showing time progression of a movement average value of an output of the inductance sensor in the case where the winding-up of the sealing sheet succeeded.

As is apparent from FIGS. 9 and 10, a bulk density of the developer in the stirring chamber 111 is high before start of the peeling-off of the sealing sheet 51*b*, and therefore an output of the inductance sensor 108 disposed in the stirring chamber 111 is large. When the peeling-off of the sealing sheet 51*b* starts and the developer flows from the stirring chamber 111 into the developing chamber 110, the output of the inductance sensor 108 lowers. Then, the winding-up of the sealing sheet 51*a* succeeds and then the developer flows from the developing chamber 110 into the stirring chamber 111 to start circulation. At this time, an amount of the developer in the stirring chamber 111 lowers compared with when the developer circulates through one full circulation and thus the circulation is stabilized, and therefore also the output of the inductance sensor 108 lowers. When the developer moves through one full circulation and thus the developer is returned to the stirring chamber 111, the output of the inductance sensor 108 increases, so that not only the circulation of the developer is stabilized but also the output of the inductance sensor 108 is stabilized.

Next, the case where the winding-up of at least one of the sealing sheets 51*a*, 51*b* failed will be considered. There are two patterns as phenomena occurring when the winding-up of the sealing sheet failed. A first phenomenon is the case where the winding-up of the sealing sheet 51*b* disposed in the downstream side of the second stirring screw 111*a* with respect to the developer feeding direction failed. In this case, even when the winding-up of the downstream sealing sheet 51*a* failed or succeeded, the substantially same phenomenon occurs. In this case, the developer sealed in the stirring chamber 111 cannot flow into the developing chamber 110. For this reason, the developer gathers at the downstream side with respect to an arrow A direction in (b) of FIG. 7. In this state, as shown in FIG. 3, the bulk density of the developer in the neighborhood of the inductance sensor 108 disposed in the stirring chamber 111 gradually becomes high, with the result that the output of the inductance sensor 108 gradually increases.

Figure 11:
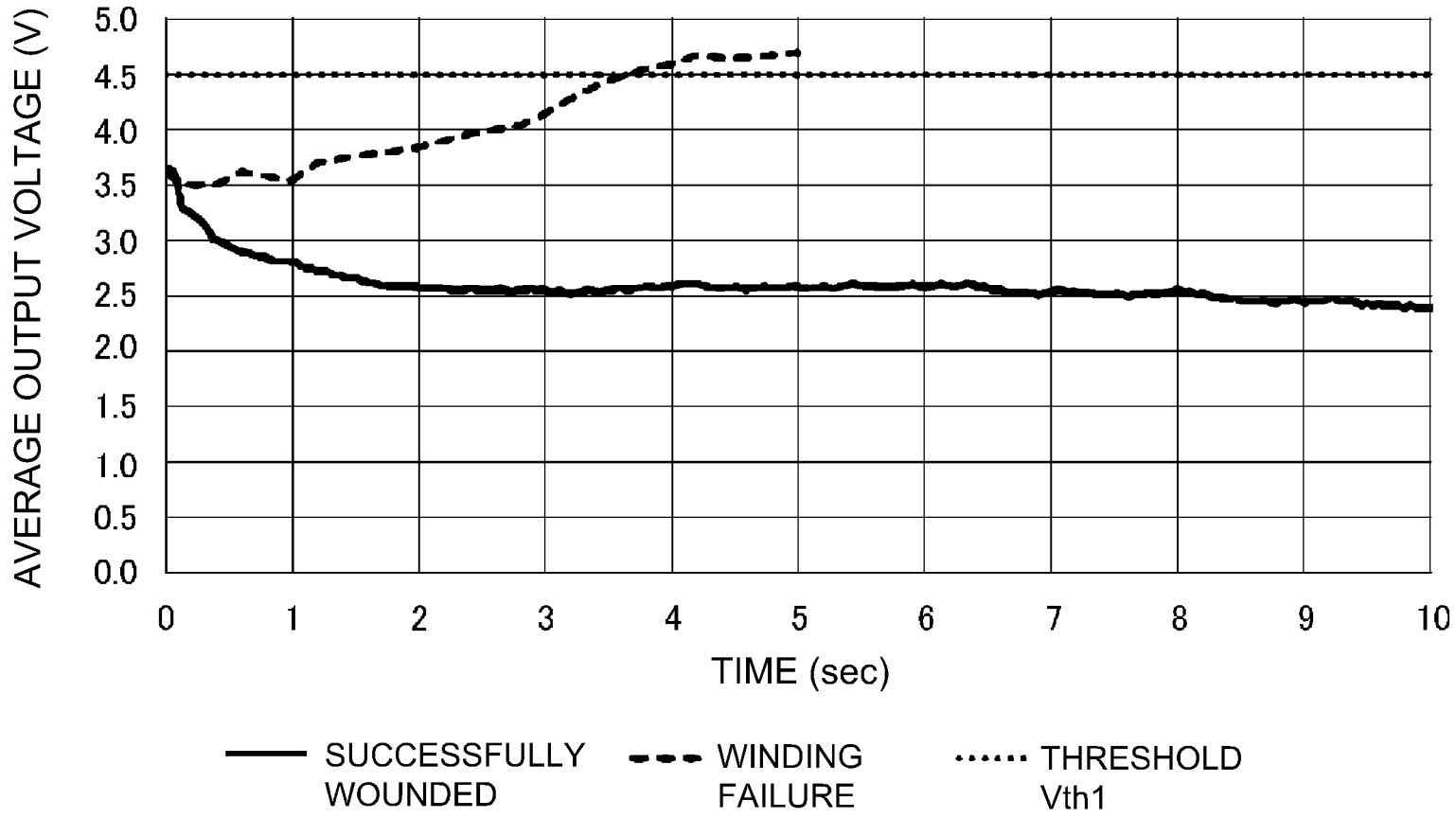
FIG. 11 is a graph showing time progression of a movement average value of an output of the inductance sensor in the First Embodiment in each of the case where the winding-up of the sealing sheet succeeded and the case where the winding-up of the sealing sheet at a downstream portion with respect to a developer feeding direction of a second stirring screw failed.

Here, FIG. 11 shows time progressions of a movement average value V_ave of the output waveform of the inductance sensor 108 in the case where the winding-up of the two sealing sheets 51*a*, 51*b* succeeded (solid line) and the case where the winding-up of the sealing sheet 51*b* failed (broken line). Also FIG. 11 shows the time progressions from the winding-up start timing of the sealing sheet 51*b*.

As shown in FIG. 11 by the broken line, in the case where the winding-up of the sealing sheet 51*b* failed, it is understood that the output of the inductance sensor 108 gradually increases. In the constitution disclosed in Japanese Patent No. 5183103 described hereinabove, unless the user (service person) waits for a time from the peeling-off of the sealing sheet 51*b* to a scheduled time when the developing sleeve 102 carries the developer, whether or not the winding-up of the sealing sheet 51*b* succeeded cannot be discriminated. On the other hand, as in this embodiment, when the discrimination is made on the basis of the output of the inductance sensor 108, the discrimination can be made earlier than the discrimination in the constitution disclosed in Japanese Patent No. 5183103.

In this embodiment, the movement average value V_ave of the output of the inductance sensor 108 and a failure threshold 1 (Vth1) as a second upper limit (predetermined upper limit) smaller than a first upper limit as described later are compared, so that winding-up failure of the sealing sheet 51*b* is detected. Specifically, in the case where the movement average value V_ave of the output of the inductance sensor 108 is not less than the failure threshold 1 (Vth1) (4.5 V in this embodiment) (i.e., not less than the second upper limit), the CPU 300 discriminates that the winding-up of the sealing sheet 51*b* failed. That is, the CPU 300 discriminates that the sealing sheet 51*b* is not removed.

Next, a second phenomenon occurring when the winding-up of the sealing sheet failed in the case where the winding-up of the sealing sheet 51*b* succeeded but the winding-up of the sealing sheet 51*a* failed. In this case, the developer sealed in the stirring chamber 111 flows from the stirring chamber 111 into the developing chamber 110, but the stirring chamber 111 and the developing chamber 110 do not communicate with each other due to the existence of the sealing sheet 51*a*. For this reason, the developer flowing into the developing chamber 110 cannot be returned from the developing chamber 110 to the stirring chamber 111, and therefore the amount of the developer in the stirring chamber 111 becomes gradually small. In this state, also the amount of the developer in the neighborhood of the inductance sensor 108 becomes small, and therefore as a result, the output of the inductance sensor 108 gradually lowers.

Figure 12:
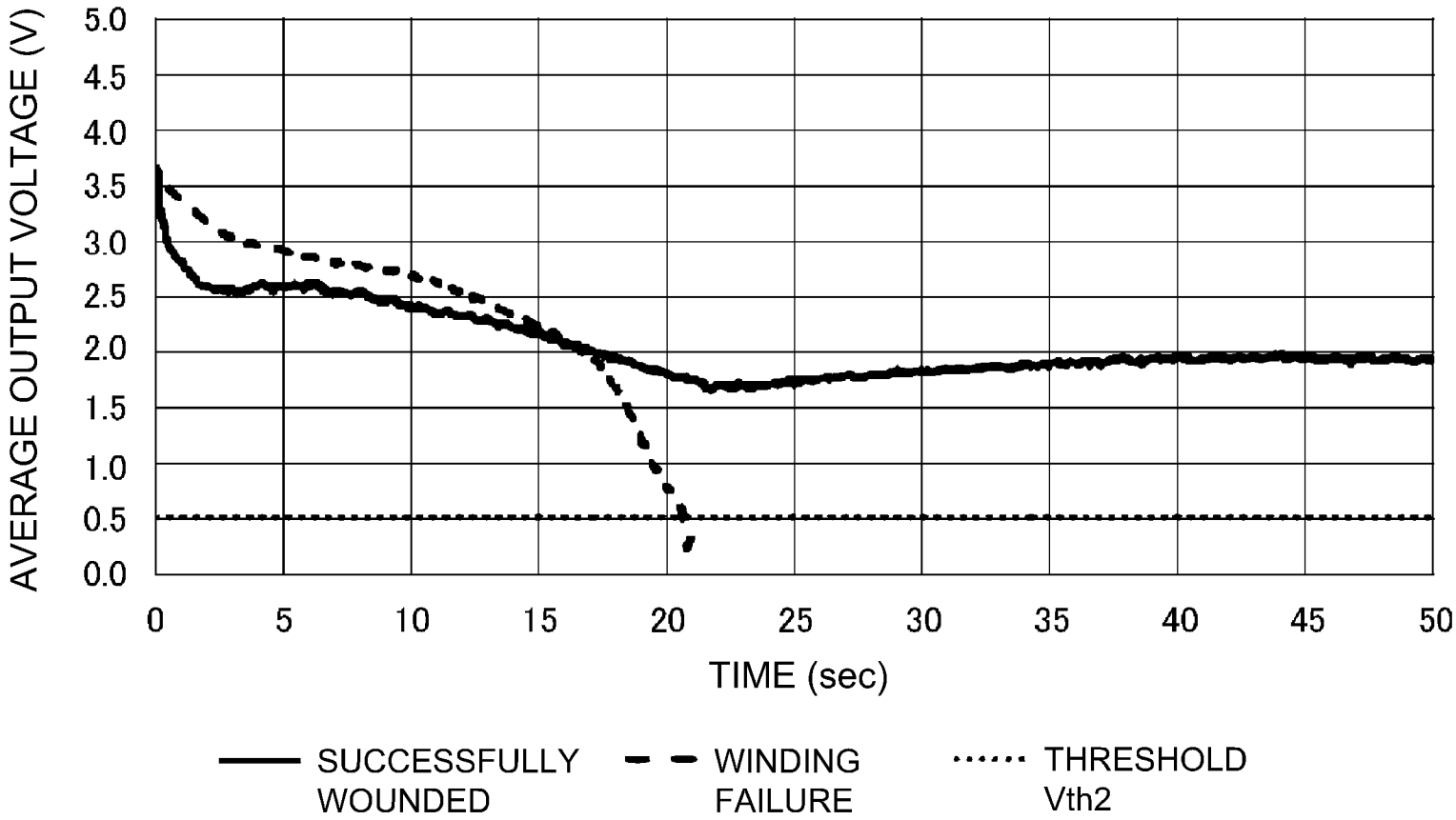
FIG. 12 is a graph showing time progression of a movement average value of an output of the inductance sensor in the First Embodiment in each case where the winding-up of the sealing sheet succeeded and the case where the winding-up of the sealing sheet at a upstream portion with respect to the developer feeding direction of a second stirring screw failed.

FIG. 12 shows a time progression of a movement average value V_ave of the output waveform of the inductance sensor 108 in the case where the winding-up of the sealing sheet 51*a* succeeded but the winding-up of the sealing sheet 51*a* failed (broken line). Also FIG. 12 shows the time progression from the winding-up start timing of the sealing sheet 51*b*, and also shows the case where the winding-up of the two sealing sheets 51*a*, 51*b* succeeded (solid line).

As shown in FIG. 12 by the broken line, in the case where the winding-up of the sealing sheet 51*a* failed, it is understood that the output of the inductance sensor 108 gradually lowers. In the constitution disclosed in Japanese Patent No. 5183103 described hereinabove, the developer flows into the developing chamber 110 in this case, and therefore the developer is carried on the developing sleeve 102. Accordingly, failure of winding-up of the sealing sheet 51*a* cannot be detected.

In this embodiment, the movement average value V_ave of the output of the inductance sensor 108 and a failure threshold 2 (Vth2) as a second lower limit (predetermined lower limit) larger than a first lower limit as described later are compared, so that winding-up failure of the sealing sheet 51*a* is detected. Specifically, in the case where the movement average value V_ave of the output of the inductance sensor 108 is not more than the failure threshold 2 (Vth2) (0.5 V in this embodiment) (i.e., not more than the second lower limit), the CPU 300 discriminates that the winding-up of the sealing sheet 51*a* failed. That is, the CPU 300 discriminates that the sealing sheet 51*a* is not removed.

The output of the inductance sensor 108 is not stabilized for some time after the developing device 100*a* is driven.

For this reason, after a lapse of a predetermined time from start of the initial driving of the developing device 100*a*, e.g., from the winding-up start timing of the sealing sheet 51*a* which is a slow winding-up start timing, the CPU 300 may also start detection by the above-described inductance sensor 108.

Thus, in this embodiment, the CPU 300 discriminates, during the initial driving of the developing device 100*a*, whether or not the sealing sheets 51*a*, 51*a* are removed on the basis of a detection result of the inductance sensor 108. In the case where the CPU 300 discriminates that the sealing sheets 51*a*, 51*b* are not removed, the CPU 300 stops the operation of the image forming apparatus 200. That is, the CPU 300 stops all of the driving of the developing device 100*a*, the photosensitive drum 1*a* and the like which are driven during the initial driving. At the same time, a message to the effect that the sealing sheets 51*a*, 51*b* are not removed is notified to, e.g., the operating panel 301 or the external terminal connected with the image forming apparatus 200.

Abnormality During Image Formation

Here, the case where abnormality generating during the image formation is detected by the inductance sensor 108 will be described. In this embodiment, as described above, during the initial driving of the developing device 100*a*, whether or not the sealing sheets are removed is discriminated on the basis of the output of the inductance sensor 108. However, in some cases, the output of the inductance sensor 108 is abnormal also during the image formation. For example, the case where the amount of the developer in the developing container 101 becomes abnormally small for the reason that the developer is not properly supplied or the like and the case where the amount of the developer in the developing container 101 becomes large for the reason that the developer is excessively supplied or the like generate. In these cases, the CPU 300 not only stops the operation of the image forming apparatus 200 but also notifies a message to the effect that the image forming apparatus 200 is abnormal to the user through the operating panel 301.

The abnormality of the image forming apparatus 200 is detected on the basis of the output of the inductance sensor 108 in the following manner. First, also in this case, the movement average value V_ave of the output of the inductance sensor 108 is detected. In the case where the movement average value is not more than the first lower limit smaller than the winding-up failure threshold 2 (Vth2), the CPU 300 notifies that the image forming apparatus 200 is abnormal. That is, in the case where the amount of the developer in the developing container 101 becomes abnormally small for the reason that the developer is not properly supplied or the like, an output value of the inductance sensor 108 becomes low. At this time, in the case where the second lower limit is the winding-up failure threshold 2 (Vth2), the threshold to be discriminated is excessively high, and therefore there is a possibility that erroneous detection is made. On the other hand, it would be considered that the winding-up failure threshold 2 (Vth2) is lowered to a value equal to the first lower limit which is a threshold for abnormality detection during the image formation. However, in this case, the threshold is excessively low and therefore it takes much time to detect the winding-up of the sealing sheets.

Similarly, the movement average value V_ave of the output of the inductance sensor 108 is detected, and then in the case where the movement average value is not less than the first upper limit larger than the winding-up failure threshold 1 (Vth1), the CPU 300 notifies that the image forming apparatus 200 is abnormal. That is, in the case where the amount of the developer in the developing container 101 becomes abnormally large for the reason that the developer is excessively supplied or the like, an output value of the inductance sensor 108 becomes high. At this time, in the case where the first upper limit is the winding-up failure threshold 1 (Vth1), the threshold to be discriminated is excessively low, and therefore there is a possibility that erroneous detection is made. On the other hand, it would be considered that the winding-up failure threshold 1 (Vth1) is lowered to a value equal to the first upper limit which is a threshold for abnormality detection during the image formation. However, in this case, the threshold is excessively high and therefore it takes much time to detect the winding-up of the sealing sheets.

For this reason, in this embodiment, the threshold for discriminating the abnormality is made different between during the initial driving of the developing device 100*a* and during the image formation depending on the output of the inductance sensor 108. That is, the CPU 300 executes an operation in a first detecting mode during the image formation and an operation in a second detecting mode, different from the first detecting mode, during the initial driving of the developing device 100*a*. Then, in the case where a predetermined condition is satisfied in the operation in the second detecting mode, the CPU 300 discriminates that the sealing sheets are not removed. That is, in the case where the output value of the inductance sensor 108 is not more than the second lower limit larger than the first lower limit (in the case where the movement average value is not more than the failure threshold 2 (Vth2)), the CPU 300 discriminates that the sealing sheets are not removed. Further, in the case where the output value of the inductance sensor 108 is not less than the second upper limit smaller than the first upper limit (in the case where the movement average value is not less than the failure threshold 1 (Vth1)), the CPU 300 discriminates that the sealing sheets are not removed.

On the other hand, in the operation in the first detecting mode, in the case where the output value of the inductance sensor 108 is not more than the first lower limit smaller than the second lower limit, the CPU 300 discriminates that the image forming apparatus 200 is abnormal (e.g., that the amount of the developer in the developing container 101 is abnormally small). Further, in the case where the output value of the inductance sensor 108 is not less than the first upper limit larger than the second upper limit, the CPU 300 discriminates that the image forming apparatus 200 is abnormal (e.g., that the amount of the developer in the developing container 101 is abnormally large).

Initial Installation Sequence of Developing Device

An initial installation sequence of the developing device 100*a* in this embodiment will be described using FIG. 13. As described above, in the developing device 100*a* in this embodiment, the sealing sheets 51*a*, 51*b* are not manually removed by the user or the service person but are automatically removed using the driving motor M of the image forming apparatus 200. For that reason, it is possible to provide the developing device 100*a* high in usability. First, the user or the service person sets the developing device 100*a*, in which a fresh developer is sealed, in the apparatus main assembly 201 of the image forming apparatus 200. Incidentally, this operation is similarly performed also during actuation of the image forming apparatus 200 in which a new developing device 100*a* is set in advance.

Then, the user or the service person inputs an instruction of initial installation into the operating panel 301. In the case where the developing device 100*a* is provided with a memory tag, when the memory tag discriminates that the developing device 100*a* is a new developing device, an initial installation sequence of the developing device 100*a* is started (S1). When the initial installation sequence is started, the CPU 300 actuates the driving motor M disposed in the image forming apparatus 200 to start driving of the developing device 100*a*, so that the developing sleeve 102 is rotated (S2). By the above-described gear train, in interrelation with the developing sleeve 102, the first stirring screw 100*a*, the second stirring screw 111*a*, the third stirring screw 111*b* and the winding-up shaft 601 rotate simultaneously.

As shown in (b) of FIG. 7, the second stirring screw 111*a* rotates and feeds the developer in the arrow A direction in the stirring chamber 111. However, the downstream sealing sheet 51*b* is not yet peeled off, and therefore the developer gathers at the downstream side with respect to the arrow A direction. However, the developer gathered is fed in the arrow C direction by the third stirring screw 111*b*, and therefore the developer is divided vertically and then is circulated in the stirring chamber 111. For this reason, it is possible to suppress an abrupt increase in torque of the second stirring screw 111*a* and to suppress excessive torque of the second stirring screw 111*a* during the peeling-off of the sealing sheet 51*b*.

A folded-back length of the sealing sheet 51*b* is shorter than that of the sealing sheet 51*a*, and therefore a bonded portion of the sealing sheet 51*b* is started to be peeled off earlier than a bonded portion of the sealing sheet 51*a* by rotation of the winding-up shaft 601 also during circulation of the developer in the stirring chamber 111 (S3). Then, the second opening 107*b* is started to be exposed. Next, behind the sealing sheet 51*b*, the bonded portion of the sealing sheet 51*a* is in a state of being peeled off, so that also the first opening 107*a* is started to be exposed.

When the sealing sheet 51*b* is peeled and the second opening 107*b* is started to be exposed, the amount of the developer pushed out into the developing chamber 110 by the second stirring screw 111*a* gradually increases. Then, by the first stirring screw 110*a*, the developer in the developing chamber 110 is fed toward the downstream side of the first stirring screw 110*a* with respect to the developer feeding direction.

When the developer fed by the first stirring screw 110*a* reaches the first opening 107*a*, a time elapses for some time from start of the peeling of the sealing sheet 51*a*. For this reason, the developer flows from the developing chamber 110 into the stirring chamber 111 through the first opening 107*a* without being blocked by the sealing sheet 51*a*, so that the developer is fed in the stirring chamber 111 by the second stirring screw 111*a*. As a result, the developer starts circulation in the developing container 101.

Output detection of the inductance sensor 108 is started from timing when the peeling of the sealing sheet 51*a* is started. The detection start timing of the inductance sensor 108 may only be required that the detection is started at least after the developing device 100*a* is driven, but in this embodiment, the detection start timing was winding-up start timing of the sealing sheet 51*a* when the output of the inductance sensor 108 starts stabilization thereof (S4). Incidentally, if the output of the sensor is stabilized further early, the detection start timing of the inductance sensor 108 may also be winding-up start timing of the sealing sheet 51*b*.

After the start of the detection of the output of the inductance sensor 108, at an interval of a rotation period of the second stirring screw 111*a*, the movement average value V_ave of the inductance sensor 108 is calculated (S5). An average calculating method is not limited to a method of calculating a simple movement average value. Thus, the movement average value V_ave of the output of the inductance sensor 108 is calculated and then compared with the winding-up failure threshold 1 (Vth1) (S6). In the step S6, the CPU 300 discriminates whether or not the movement average value V_ave is not less than the winding-up failure threshold 1 (Vth1). When the movement average value V_ave is less than the winding-up 1 (Vth1) (i.e., V_ave<Vth1), the sequence goes to a next step.

Then, the movement average value V_ave and the winding-up failure threshold 2 (Vth2) are compared with each other (S7). In the step S7, the CPU 300 discriminates whether or not the movement average value V_ave is not more than the winding-up failure threshold 2 (Vth2). When the movement average value V_ave is larger than the winding-up failure threshold 2 (Vth2) (i.e., V_ave>Vth2), the sequence goes to a next step. When the movement average value V_ave of the output of the inductance sensor 108 is smaller than the winding-up failure threshold 1 (Vth1) and larger than the winding-up failure threshold 2 (Vth2), the driving of the developing device 100*a* and the output detection of the inductance sensor 108 are continued. That is, the driving and the detection are continued until a lapse of the developing driving time of the initial installation sequence (120 sec from the start of the driving of the developing device 100*a* in this embodiment) (S8). When the developing driving time of the initial installation sequence elapsed, the two-component developer filled in the developing container 101 is sufficiently stirred and mixed, and thus the initial installation of the developing device 100*a* is ended (S9), so that the image forming apparatus 200 is at rest (S10). Thereafter, in the case where the image formation is effected, the image forming operation is effected, the image forming operation is performed as usual.

On the other hand, in the step S6, when the movement average value V_ave is not less than the winding-up failure threshold 1 (Vth1) or in the step S7, when the movement average value V_ave is not more than the winding-up failure threshold 2 (Vth2), the corresponding number of times thereof is counted up. That is, the number of times of the discrimination of "N" (the number of times of NG) is counted by the CPU 300 in each of the steps S6 and S7. Then, in the case where at least one of the number of times of NG in the step S6 and the number of times of NG in the step S7 is continuously detected 5 times (S11), the CPU 300 discriminates that the winding-up of the sealing sheet 51*a* and/or the sealing sheet 51*b* failed and then notifies warning to the operating panel 301 or the like (S12). Thereafter, the image forming apparatus 200 is stopped (S10). In the step S11, in order to further enhance accuracy of the discrimination, in the case where the number of times of NG is continuously detected 5 times, the CPU 300 discriminated that the winding-up failed, but the number of times of NG for the discrimination is not limited to 5 times.

As described above, in the case of this embodiment, the movement average value V_ave of the output of the inductance sensor 108 after the start of the developing driving of the developing device 100*a* during the initial installation sequence is compared with the winding-up failure threshold 1 (Vth1) and the winding-up failure threshold 2 (Vth2). Then, whether not the winding-up of the sealing sheet 51*a* and/or the sealing sheet 51*b* succeeded. As a result, it is possible to discriminate whether or not even the sealing sheet for either of the first and second openings 107*a*, 107*b* is removed. Further, compared with the constitution disclosed in Japanese Patent No. 5183103, the time until the discrimination is made can be made earlier. Then, in the case where discrimination that either of the sealing sheets is not removed is made, the operation of the image forming apparatus 200 is stopped, so that it is possible to reduce a degree of breakage of a driving system for the developing device 100*a* or the image forming apparatus 200 and a degree of contamination of the image forming apparatus 200 with the overflowing developer.

Second Embodiment

Figure 15:
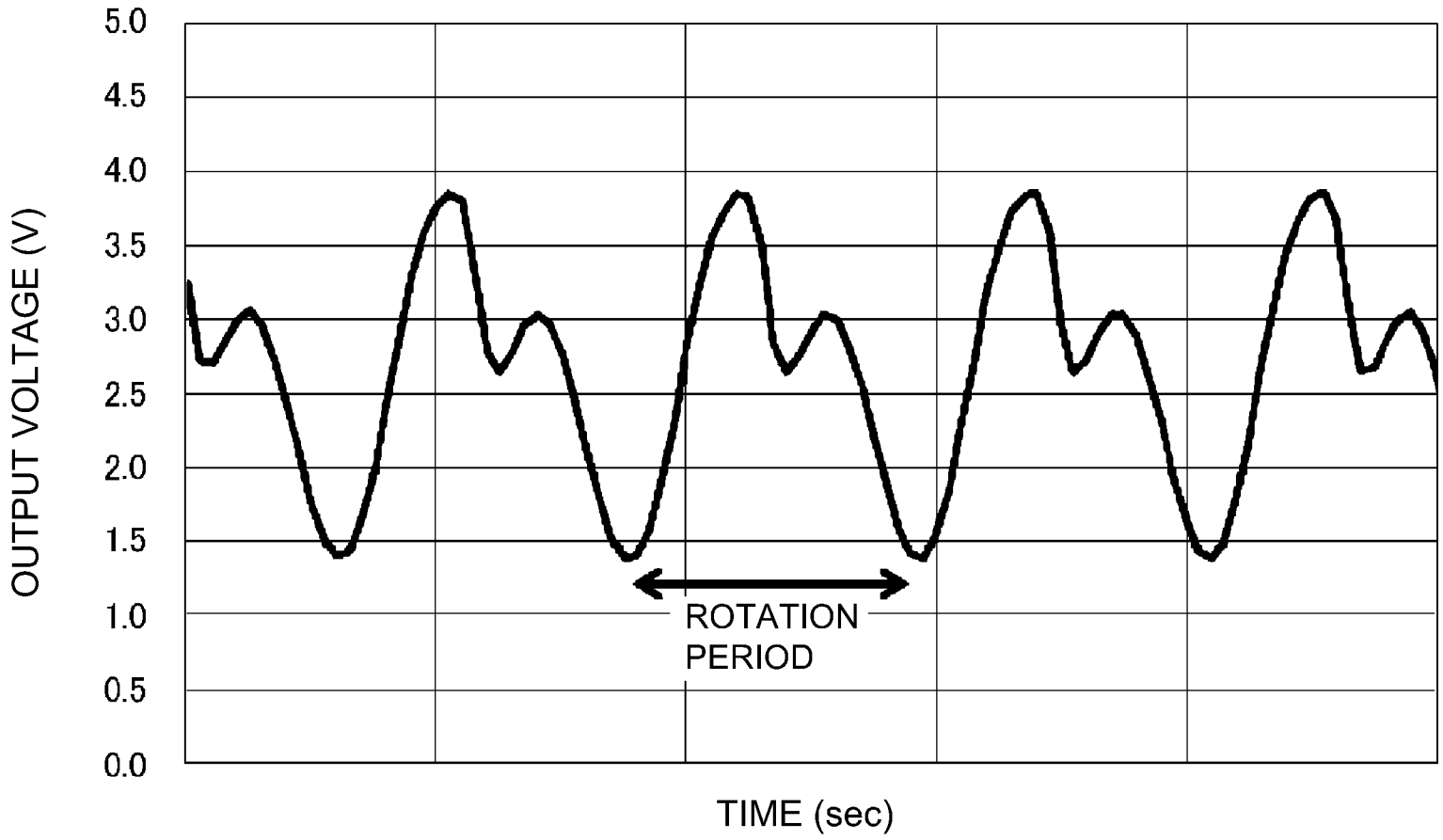
FIG. 15 is a graph showing time progression waveform of an inductance sensor in the Second Embodiment.
Figure 16:
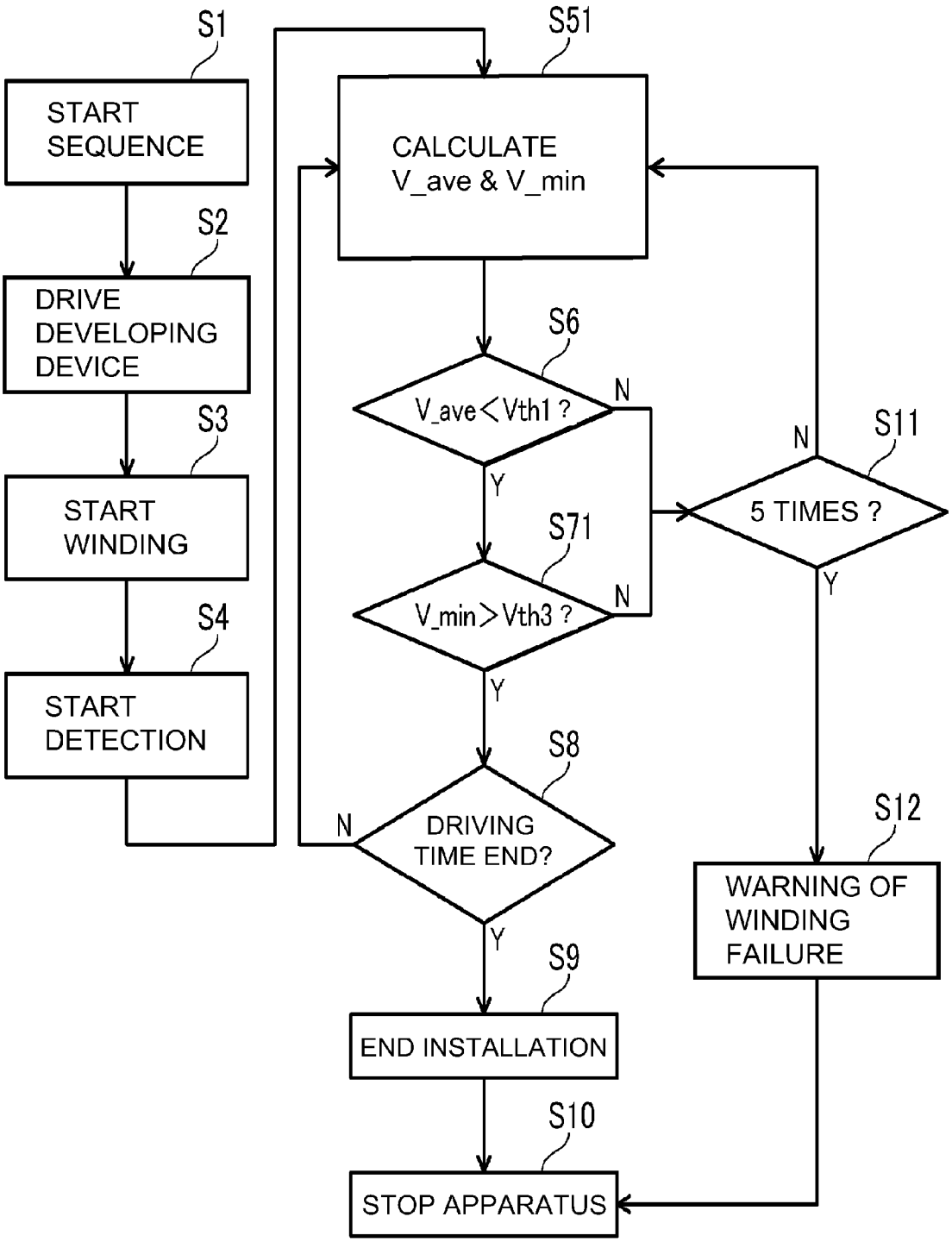
FIG. 16 is a flowchart of an initial installation sequence of a developing device in the Second Embodiment.

Second Embodiment of the present invention will be described using FIGS. 14 to 16. This embodiment is different from First Embodiment described above in that the stirring rib of the second stirring screw 111*a* is provided with a magnetic member. Accordingly, constitutions similar to those in First Embodiment are omitted or simplified from illustration or description and a portion different from First Embodiment will be principally described.

Figure 14:
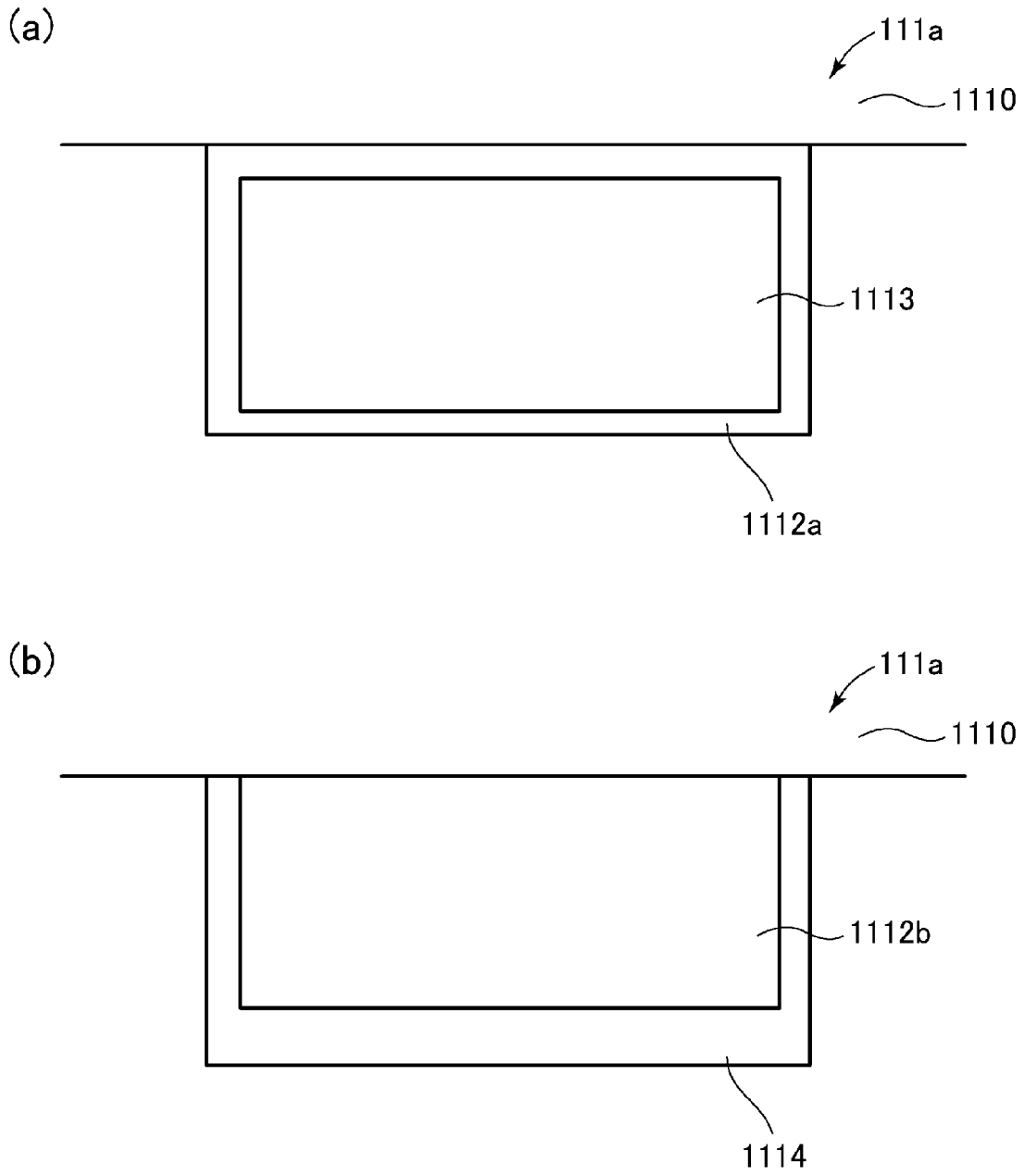
In FIG. 14, (a) is a schematic view showing a stirring rib including therein a magnetic member in a Second Embodiment, and (b) is a schematic view showing a stirring rib provided with an urethane sheet at a periphery thereof in the Second Embodiment.

As shown in (a) of FIG. 14, of the plurality of the second stirring screw 111*a* in this embodiment, at least a stirring rib 1112*a* provided at a position opposing the inductance sensor 108 (FIG. 3) includes a magnetic member (material) 1113. The magnetic member is a ferrite of 50 mT in magnetic flux, for example. The stirring rib 1112*a* including the magnetic member 1113 may also be provided as all of the stirring ribs of the second stirring screw 111*a* or may also be provided only as the stirring rib opposing the inductance sensor 108. In this way, the stirring rib 1112*a* includes the magnetic member 1113, so that the developer is held and stirred, and therefore it is possible to further suppress a degree of stagnation of the developer at a periphery of the inductance sensor 108. Thus, replacement of the developer at the periphery of the inductance sensor 108 is further made, so that the detection by the inductance sensor 108 is made with high accuracy.

An output wavelength of the inductance sensor 108 in the case where the second stirring screw 111*a* having the stirring rib 1112*a* including the magnetic 1113 is used as described above is shown in FIG. 15. A time progression of the output of the inductance sensor 108 forms a peak-to-peak state with a rotation period of the second stirring screw 111*a*. In the case where the stirring rib 1112*a* includes the magnetic member 1113. The developer is held on the stirring rib 1112*a* by the magnetic member 1113. For this reason, when the stirring rib 1112*a* approaches the neighborhood of the position opposing the inductance sensor 108, the held developer is press-contacted to the inductance sensor 108. As a result, a bulk density of the developer in the neighborhood of the stirring rib 1112*a* and the inductance sensor 108 increases, and compared with the case described above with reference to FIG. 5, an output voltage of the inductance sensor 108 increases. For this reason, a maximum of the output voltage of the inductance sensor 108 increases compared with the case where the stirring rib does not include the magnetic member.

Even when the amount of the developer in the stirring chamber 111 (FIG. 3) lowers, the stirring rib 1112*a* continuously carries the developer by the magnetic member 1113, and therefore an output value in the case where the stirring rib 1112*a* is closest to the neighborhood of the inductance sensor 108 increases. For that reason, a difference in movement average value V_ave of the output of the inductance sensor 108 becomes small between the case where the developer sufficiently exists in the stirring chamber 111 and the case where the developer does not sufficiently exist in the stirring chamber 111. For this reason, as described in the First Embodiment, when the discrimination is made on the basis of the movement average value and the winding-up failure threshold 2 (Vth2), there is a possibility that the winding-up failure is erroneously detected or that it takes much time until the discrimination is made.

Figure 17:
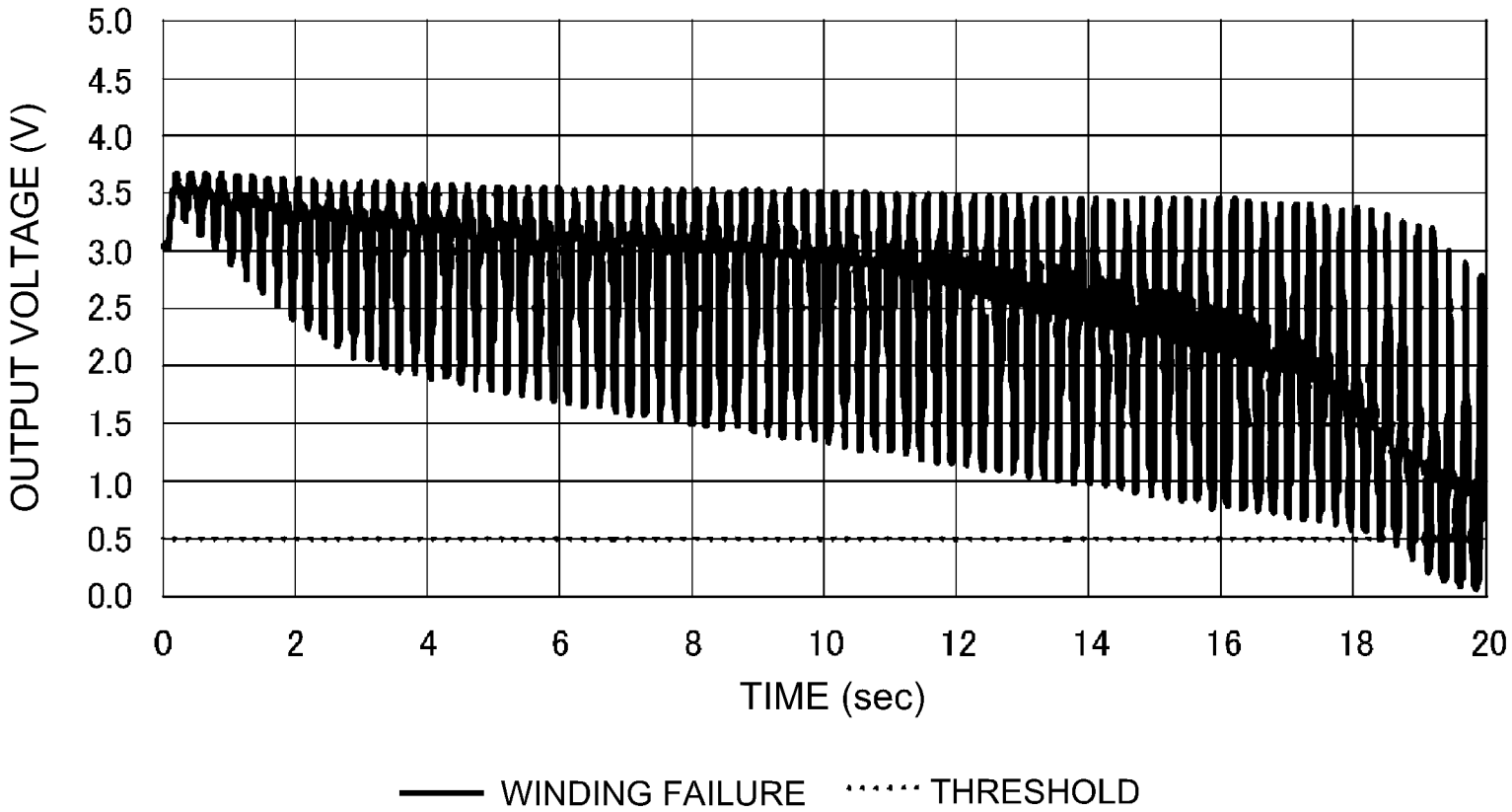
FIG. 17 is a graph showing time progression of the output waveform of the inductance sensor in the Second Embodiment in the case where winding-up of a sealing sheet at an upstream portion with respect to a developer feeding direction of a second stirring screw failed.

This will be described using FIG. 17 showing a time progression of an output waveform of the inductance sensor 108 in the case where the winding-up of the sealing sheet 51*b* ((b) of FIG. 7) succeeded but the winding-up of the sealing sheet 51*a* ((b) of FIG. 7) failed. As shown in FIG. 17, the time progression of the output voltage of the inductance sensor 108 during the initial installation forms the peak-to-peak state with the rotation period of the second stirring screw 111*a*. Further, it is understood that in the peak-to-peak state, a time change in maximum is small, whereas a time change in minimum is large. This is because the maximum in the peak-to-peak state is a value when the stirring rib 1112*a* approaches the neighborhood of the inductance sensor 108 and the held developer is in a press-contacted state, and therefore the influence thereof on a change in amount of the developer in the stirring chamber 111 is small. On the other hand, the minimum in the peak-to-peak state is a value when the stirring rib 1112*a* is at a phase where the stirring rib 1112*a* is remotest from the inductance sensor 108, and therefore the amount of the developer to be fed largely depends on the second stirring screw 111*a*.

In the case where the winding-up of the sealing sheet 51*b* succeeded but the winding-up of the sealing sheet 51*a* failed, similarly as in First Embodiment, the amount of the stirring chamber 111 largely lowers. For this reason, by comparing the minimum and the threshold of the output voltage of the inductance sensor 108 with each other in the rotation period of the second stirring screw 111*a*, in the case where the winding-up of the sealing sheet 51*b* succeeded, whether or not the winding-up of the sealing sheet 51*a* succeeded can be discriminated with high accuracy.

Therefore, in this embodiment, in the rotation period of the second stirring screw 111*a*, a minimum V_min of the output value of the inductance sensor 108 and a winding-up failure threshold 3 (Vth3) as a second lower limit (predetermined lower limit) are compared with each other. As a result, whether or not the winding-up of the sealing sheet 51*a* succeeded is discriminated. FIG. 16 shows a control flowchart of the initial installation sequence of the developing device 100*a* in this embodiment. In FIG. 16, steps other than S51, S71 are similar to those in FIG. 13 in the First Embodiment.

Figure 13:
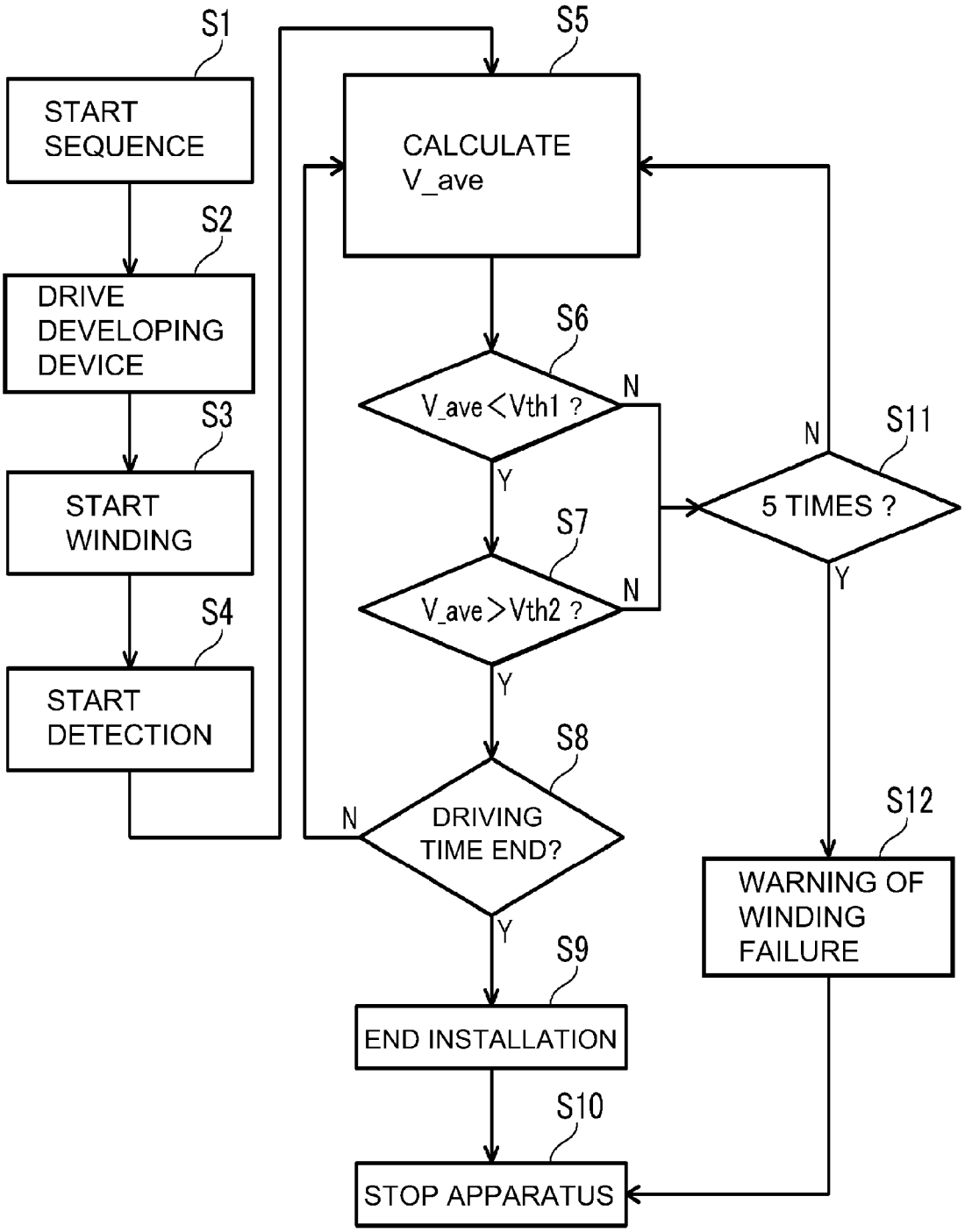
FIG. 13 is a flowchart of an initial installation sequence of the developing device in the First Embodiment.

In this embodiment, in the step S51, compared with the step S5 in FIG. 13, an operation for calculating the minimum V_min of the output voltage of the inductance sensor 108 in the rotation period of the second stirring screw 111*a* is added. Further, in the step S71, in place of the step S7 in FIG. 13, an operation for comparing the minimum V_min of the output voltage of the inductance sensor 108 and the winding-up failure threshold 3 (Vth3) with each other is performed. The winding-up failure threshold 3 (Vth3) was set at 0.5 V similarly as in the case of the winding-up failure threshold 2 (Vth2) in the First Embodiment. In the step S71, the CPU 300 (FIG. 3) discriminates whether or not the minimum V_min is not more than the winding-up failure threshold 3 (Vth3). When the minimum V_min is larger than the winding-up failure threshold 3 (Vth3) (i.e., V_ave>Vth3), the sequence goes to a next step. When the movement average value V_ave of the output of the inductance sensor 108 is smaller than the winding-up failure threshold 1 (Vth1) and the minimum V_min is larger than the winding-up failure threshold 3 (Vth3), the driving of the developing device 100*a* and the output detection of the inductance sensor 108 are continued. That is, the driving and the detection are continued until a lapse of the developing driving time of the initial installation sequence (120 sec from the start of the driving of the developing device 100*a* in this embodiment) (S8).

On the other hand, in the step S6, when the movement average value V_ave is not less than the winding-up failure threshold 1 (Vth1) or in the step S71, when the minimum V_min is not more than the winding-up failure threshold 3 (Vth3), the corresponding number of times thereof is counted up. That is, the number of times of the discrimination of "N" (the number of times of NG) is counted by the CPU 300 in each of the steps S6 and S71. Then, in the case where at least one of the number of times of NG in the step S6 and the number of times of NG in the step S71 is continuously detected 5 times (S11), the CPU 300 discriminates that the winding-up of the sealing sheet 51*a* and/or the sealing sheet 51*b* failed and then notifies warning to the operating panel 301 or the like (S12). Thereafter, the image forming apparatus 200 is stopped (S10). In the step S11, in order to further enhance accuracy of the discrimination, in the case where the number of times of NG is continuously detected 5 times, the CPU 300 discriminated that the winding-up failed, but the number of times of NG for the discrimination is not limited to 5 times.

As described above, in the case of this embodiment, the movement average value V_ave of the output of the inductance sensor 108 after the start of the developing driving of the developing device 100*a* during the initial installation sequence is compared with the winding-up failure threshold 1 (Vth1) and the minimum V_min is compared with the winding-up failure threshold 3 (Vth3), respectively. Then, whether not the winding-up of the sealing sheet 51*a* and/or the sealing sheet 51*b* succeeded. As a result, similarly as in the First Embodiment, it is possible to discriminate whether or not even the sealing sheet for either of the first and second openings 107*a*, 107*b* is removed. Particularly, as in this embodiment, in the constitution in which the stirring rib includes the magnetic member, the winding-up failure of the upstream sealing sheet 51*a* can be discriminated with high accuracy. Further, compared with the constitution disclosed in Japanese Patent No. 5183103, the time until the discrimination is made can be made earlier. Then, in the case where discrimination that either of the sealing sheets is not removed is made, the operation of the image forming apparatus 200 is stopped, so that it is possible to reduce a degree of breakage of a driving system for the developing device 100*a* or the image forming apparatus 200 and a degree of contamination of the image forming apparatus 200 with the overflowing developer.

In the above-described constitution, the case where the stirring rib 1112*a* includes the magnetic member 1113 was described, but as shown in (b) of FIG. 14, also in a constitution in which as a stirring rib 1112*b*, a urethane sheet 1114 is provided at a periphery of the stirring rib 1112*b*, this embodiment is applicable thereto. That is, also in the case of this embodiment, the developer is held by this urethane sheet 1114, and therefore it is possible to further suppress the stagnation of the developer at the periphery of the inductance sensor 108. However, the output waveform of the inductance sensor 108 is similar to the output waveform in the case where the magnetic member 1113 is provided, and therefore also to the constitution in which the stirring rib 1112*a* is provided with the urethane sheet 1114, this embodiment is preferably applicable.

Other Embodiments

In the above-described embodiments, the case where the winding-up of the sealing sheets is automatically performed was described. However, the present invention is also applicable to the case where the sealing member such as the sealing sheet is manually removed. That is, also in the case where the user forgets about removing the sealing member, the control in the above-described embodiments is executed, so that it is possible to detect that the sealing sheet is not removed.

In the embodiments described above, the inductance sensor was disposed downstream of the second stirring screw with respect to the developer feeding direction. However, even in either of the cases, when the inductance sensor is disposed in the neighborhood of the sealing sheet, it is possible to easily detect earlier that the sealing sheet is not detected. In the above-described embodiments, the inductance sensor is disposed in the downstream side of the stirring chamber so that the developer supplied to the stirring chamber can be sufficiently stirred and then can be detected.

According to the present invention, whether or not the sealing member at the opening has been removed can be discriminated, and the time until the discrimination is made can be made early.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-252135 filed on Dec. 12, 2014, which is hereby incorporated by reference herein in its entirety.

What is claimed is:

1. An image forming apparatus comprising:

an image bearing member for bearing an electrostatic latent image;

a developing device for developing the electrostatic latent image, borne on said image bearing member, into a toner image with a toner;

a driving device for driving said developing device; and a controller for controlling said image forming apparatus, wherein said developing device comprises, a developing container including a first chamber and a second chamber which are capable of accommodating a developer containing a non-magnetic toner and a magnetic carrier, a partition wall for partitioning said first chamber and said second chamber, a first opening, provided upstream of said second chamber with respect to a developer feeding direction, for establishing communication between said first chamber and said second chamber, and a second opening, provided downstream of said second chamber with respect to the developer feeding direction, for establishing communication between said first chamber and said second chamber, a first feeding member for feeding the developer in said first chamber, a second feeding member for feeding the developer in said second chamber in a direction opposite to a direction in said first chamber, a developer carrying member for carrying the developer while rotating and for developing the electrostatic latent image into the toner image with the toner, a content sensor, provided in said second chamber, for detecting a toner content in said developing container on the basis of permeability of the developer, and a sealing member for unsealably sealing the first opening and said second opening in a state in which the developer is accommodated in the second chamber, wherein when said controller executes an initializing operation for removing said sealing member from the first opening and the second opening while driving said first feeding member and said second feeding member, said controller provides notification of abnormality when said controller discriminates that an amount of the developer in said second chamber is larger than a predetermined amount at predetermined timing on the basis of an output of said content sensor.

2. An image forming apparatus according to claim 1, wherein when an output value of said content sensor is not less than a first upper limit value during image formation, said controller provides notification to the effect that said image forming apparatus is abnormal, and when the output value of said content sensor is not less than a second upper limit value smaller than the first upper limit value during initial driving of said developing device, said controller provides the notification to the effect that said image forming apparatus is abnormal.

3. An image forming apparatus according to claim 1, wherein when an output value of said content sensor is not more than a first lower limit value during image formation, said controller provides notification to the effect that said image forming apparatus is abnormal, and when the output value of said content sensor is not less than a second lower limit value larger than the first lower limit value during initial driving of said developing device, said controller provides the notification to the effect that said image forming apparatus is abnormal.

4. An image forming apparatus according to claim 1, further comprising removing means for removing said sealing member, wherein said driving device drives said removing means during initial driving of said developing device.

5. An image forming apparatus according to claim 1, wherein said content sensor is provided at a position opposing said second feeding member in said second chamber.

6. An image forming apparatus according to claim 1, wherein said second feeding member includes a helical blade and a plurality of stirring ribs which are formed on a rotation shaft thereof, and wherein of said plurality of stirring ribs, at least said stirring rib provided at a position opposing said content sensor includes a magnetic member.

7. An image forming apparatus according to claim 1, wherein said second feeding member includes a helical blade and a plurality of stirring ribs which are formed on a rotation shaft thereof, wherein of said plurality of stirring ribs, at least said stirring rib provided at a position opposing said content sensor includes a urethane sheet at a periphery thereof.

8. An image forming apparatus according to claim 1, wherein the predetermined amount is larger than an amount of the developer in said second chamber in an image formable state.

9. An image forming apparatus according to claim 1, wherein when said controller executes the initializing operation, said controller provides notification of abnormality when said controller discriminates that the amount of the developer in said second chamber is smaller than the predetermined amount on the basis of the output of said content sensor.

10. An image forming apparatus according to claim 9, wherein the predetermined amount is smaller than an amount of the developer in said second chamber in an image formable state.

11. An image forming apparatus according to claim 1, wherein said developer carrying member carries the developer in said first chamber.

12. An image forming apparatus according to claim 1, wherein said content sensor is an inductor sensor.

* * * * *